US009931851B1

(12) United States Patent
Marra, III et al.

(10) Patent No.: US 9,931,851 B1
(45) Date of Patent: Apr. 3, 2018

(54) FLUIDIC DISPENSING DEVICE AND STIR BAR FEEDBACK METHOD AND USE THEREOF

(71) Applicant: FUNAI ELECTRIC CO., LTD., Osaka (JP)

(72) Inventors: Michael A. Marra, III, Lexington, KY (US); Steven R. Komplin, Lexington, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

(21) Appl. No.: 15/278,369

(22) Filed: Sep. 28, 2016

(51) Int. Cl.
*B41J 2/175* (2006.01)
*B08B 3/10* (2006.01)
*B41J 2/045* (2006.01)

(52) U.S. Cl.
CPC ..... *B41J 2/175* (2013.01); *B08B 3/102* (2013.01); *B41J 2/04571* (2013.01); *B41J 2/17503* (2013.01)

(58) Field of Classification Search
CPC .... B41J 2/175; B41J 2/04571; B41J 2/17503; B08B 3/102
See application file for complete search history.

(56) References Cited

U.S. PATENT DOCUMENTS

| | | | |
|---|---|---|---|
| 5,198,156 | A | 3/1993 | Middleton et al. |
| 6,332,676 | B1 | 12/2001 | Santhanam |
| 7,172,272 | B2 | 2/2007 | Tsuchiya et al. |
| 8,608,300 | B2 | 12/2013 | Igawa et al. |
| 2001/0013886 | A1 | 8/2001 | Underwood et al. |
| 2001/0015742 | A1 | 8/2001 | Childers |
| 2001/0024225 | A1 | 9/2001 | Ishizawa et al. |
| 2001/0030675 | A1 | 10/2001 | Kobayashi et al. |
| 2002/0012026 | A1 | 1/2002 | Kubota et al. |
| 2002/0089576 | A1 | 7/2002 | Ishizawa et al. |
| 2002/0109760 | A1 | 8/2002 | Miyazawa et al. |
| 2002/0154570 | A1 | 10/2002 | Gebrian |
| 2002/0167555 | A1 | 11/2002 | Miura et al. |
| 2003/0042274 | A1 | 3/2003 | Johanson |
| 2003/0072216 | A1 | 4/2003 | Araki |
| 2003/0107950 | A1 | 6/2003 | Shepherd et al. |
| 2004/0051766 | A1 | 3/2004 | Miyazawa et al. |
| 2004/0095842 | A1 | 5/2004 | Weetman |
| 2004/0104984 | A1 | 6/2004 | Hall et al. |
| 2005/0046682 | A1 | 3/2005 | Kawamoto |
| 2005/0093211 | A1 | 5/2005 | Shiraishi et al. |
| 2005/0248634 | A1 | 11/2005 | Aruga |
| 2006/0071989 | A1 | 4/2006 | Lewey et al. |
| 2006/0268080 | A1 | 11/2006 | Nakazawa |

(Continued)

FOREIGN PATENT DOCUMENTS

| | | | |
|---|---|---|---|
| EP | 2919072 | A1 | 9/2015 |
| JP | 2006235470 | A | 9/2006 |

*Primary Examiner* — Yaovi M Ameh
(74) *Attorney, Agent, or Firm* — Aust IP Law

(57) ABSTRACT

A fluidic dispensing device includes a fluid reservoir containing fluid. A stir bar is located in the fluid reservoir and has a magnet. A generator generates a rotating magnetic field to interact with the magnet. A controller determines a range of a predetermined phase lag between an angular rotational position of the stir bar and an angular rotational position of the rotating magnetic field, determines a status of a present phase lag based on the range of the predetermined phase lag, and takes predetermined action based on the status.

10 Claims, 26 Drawing Sheets

(56) References Cited

U.S. PATENT DOCUMENTS

2006/0290753 A1 12/2006 Tatsumi et al.
2007/0019047 A1 1/2007 Kleinert et al.
2007/0052771 A1 3/2007 Inoue et al.
2007/0052773 A1 3/2007 Kawamura et al.
2007/0165485 A1 7/2007 Cai
2007/0188563 A1 8/2007 Takahashi
2007/0242114 A1 10/2007 Kubota et al.
2008/0031088 A1 2/2008 Ukita
2008/0165233 A1 7/2008 Lin et al.
2008/0186368 A1 8/2008 Silverbrook et al.
2009/0033725 A1 2/2009 Toba et al.
2009/0079802 A1 3/2009 Ito
2009/0122121 A1 5/2009 Kawasaki et al.
2009/0189931 A1 7/2009 Noro et al.
2009/0213159 A1 8/2009 Aoki et al.
2009/0251517 A1* 10/2009 Matsumoto ..... B41J 2/17596 347/86
2009/0289976 A1 11/2009 Nishimura
2009/0322840 A1 12/2009 Wanibe
2010/0103233 A1 4/2010 Akatsuka et al.
2011/0280098 A1 11/2011 Shiono
2012/0000645 A1 1/2012 Willimczik
2012/0056948 A1 3/2012 Kim et al.
2012/0062523 A1 3/2012 Park et al.
2012/0075364 A1 3/2012 Nakazawa
2012/0105555 A1 5/2012 Mcfarland et al.
2012/0140003 A1 6/2012 Szusdziara et al.
2012/0200645 A1 8/2012 Okina
2012/0200649 A1 8/2012 Igawa et al.
2012/0278996 A1* 11/2012 Park ..... D06F 33/02 8/137
2013/0342618 A1 12/2013 Frasure et al.
2014/0061961 A1 3/2014 Ishizawa et al.
2014/0098146 A1 4/2014 Kamiyama
2015/0165399 A1 6/2015 Rawlings
2015/0343784 A1 12/2015 Anderson, Jr. et al.

* cited by examiner

FLUIDIC DISPENSING DEVICE AND STIR BAR FEEDBACK METHOD AND USE THEREOF

CROSS-REFERENCE TO RELATED APPLICATIONS

This application is related to U.S. patent application Ser. No. 15/183,666, now U.S. Pat. No. 9,744,771; Ser. No. 15/183,693, now U.S. Pat. No. 9,707,767; Ser. No. 15/183,705, now U.S. Pat. No. 9,751,315; Ser. No. 15/183,722, now U.S. Pat. No. 9,751,316; Ser. Nos. 15/183,736; 15/193,476; 15/216,104; 15/239,113; 15/256,065, now U.S. Pat. No. 9,688,074; Ser. Nos. 15/373,123; 15/373,243; 15/373,635; 15/373,684; and Ser. No. 15/435,983.

BACKGROUND OF THE INVENTION

1. Field of the Invention

The present invention relates to fluidic dispensing devices, and, more particularly, to a method of maintaining a fluidic dispensing device, such as a microfluidic dispensing device, that carries a fluid for ejection.

2. Description of the Related Art

One type of microfluidic dispensing device, such as an ink jet printhead, is designed to include a capillary member, such as foam or felt, to control backpressure. In this type of printhead, the only free fluid is present between a filter and the ejection device. If settling or separation of the fluid occurs, it is almost impossible to re-mix the fluid contained in the capillary member.

Another type of printhead is referred to in the art as a free fluid style printhead, which has a movable wall that is spring loaded to maintain backpressure at the nozzles of the printhead. One type of spring loaded movable wall uses a deformable deflection bladder to create the spring and wall in a single piece. An early printhead design by Hewlett-Packard Company used a circular deformable rubber part in the form of a thimble shaped bladder positioned between a lid and a body that contained ink. The deflection of the thimble shaped bladder collapsed on itself. The thimble shaped bladder maintained backpressure by deforming the bladder material as ink was delivered to the printhead chip.

In a fluid tank where separation of fluids and particulate may occur, it is desirable to provide a mixing of the fluid. For example, particulate in pigmented fluids tend to settle depending on particle size, specific gravity differences, and fluid viscosity. U.S. Patent Application Publication No. 2006/0268080 discloses a system having an ink tank located remotely from the fluid ejection device, wherein the ink tank contains a magnetic rotor, which is rotated by an external rotary plate, to provide bulk mixing in the remote ink tank.

It has been recognized, however, that a microfluidic dispensing device having a compact design, which includes both a fluid reservoir and an on-board fluid ejection chip, presents particular challenges that a simple agitation in a remote tank does not address. For example, it has been determined that not only does fluid in the bulk region of the fluid reservoir need to be re-mixed, but re-mixing in the ejection chip region also is desirable, and in some cases, may be necessary, in order to prevent the clogging of the region near the fluid ejection chip with settled particulate.

What is needed in the art is a method of operating a stir bar that includes stir bar feedback, so as to facilitate efficient fluid re-mixing and redistribution of particulate in the fluid within a fluid reservoir.

SUMMARY OF THE INVENTION

The present invention provides a method of operating a stir bar that includes stir bar feedback, so as to facilitate efficient fluid re-mixing and redistribution of particulate in the fluid within a fluid reservoir.

The invention, in one form, is directed to a fluidic dispensing device that includes a fluid reservoir containing fluid. A stir bar is located in the fluid reservoir and has a magnet. A generator generates a rotating magnetic field to interact with the magnet. A controller determines a range of a predetermined phase lag between an angular rotational position of the stir bar and an angular rotational position of the rotating magnetic field, determines a status of a present phase lag based on the range of the predetermined phase lag, and takes predetermined action based on the status.

The invention in another form is directed to a method of operating a stir bar in a fluidic dispensing device, the fluidic dispensing device having a fluid reservoir containing fluid, the stir bar being located in the fluid reservoir, the stir bar having a magnet, the method including generating a rotating magnetic field; establishing a range of normal phase lag between an angular rotational position of the stir bar and an angular rotational position of the rotating magnetic field; and determining whether a present phase lag between the angular rotational position of the magnet of the stir bar and the angular rotational position of the rotating magnetic field is in the range of normal phase lag, wherein: if the present phase lag is not in the range of normal phase lag, then designating the present phase lag as an abnormal phase lag and taking a corrective action.

The invention in another form is directed to a method of operating a stir bar in a fluidic dispensing device, the fluidic dispensing device having a fluid reservoir containing fluid, the stir bar being located in the fluid reservoir, the stir bar having a magnet, the method including generating a rotating magnetic field; establishing a range of normal phase lag between an angular rotational position of the stir bar and an angular rotational position of the rotating magnetic field; and determining whether a present phase lag between the angular rotational position of the magnet of the stir bar and the angular rotational position of the rotating magnetic field is in the range of normal phase lag, wherein: if the present phase lag between the angular rotational position of the magnet of the stir bar and the angular rotational position of the rotating magnetic field is in the range of normal phase lag, then adjusting at least one of the angular rotational velocity of the stir bar and the angular rotational velocity of the rotating magnetic field.

The invention in another form is directed to a method of operating a stir bar in a fluidic dispensing device, the fluidic dispensing device having a fluid reservoir containing fluid, the stir bar being located in the fluid reservoir, the stir bar having a magnet, the method including generating a rotating magnetic field; generating a range of composite magnetic strength profiles representing an interaction between the magnet of the stir bar and the rotating magnetic field, each profile of the plurality of composite magnetic strength profiles being indicative of a respective phase lag between an angular rotational position of the stir bar and an angular rotational position of the rotating magnetic field; determining whether a present phase lag between the angular rotational position of the magnet of the stir bar and the angular rotational position of the rotating magnetic field falls within the range of composite magnetic strength profiles; and adjusting an angular rotational velocity of the rotating magnetic field on the basis of the determining.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
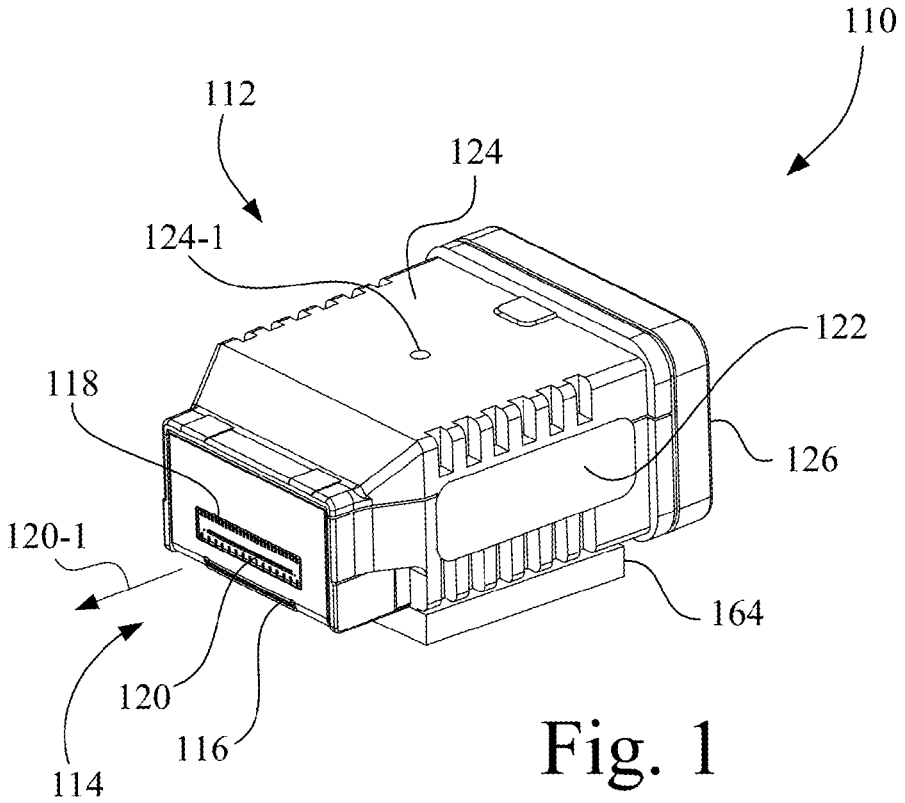
FIG. 1 is a perspective view of an embodiment of a microfluidic dispensing device in accordance with the present invention, in an environment that includes an external magnetic field generator.
Figure 2:
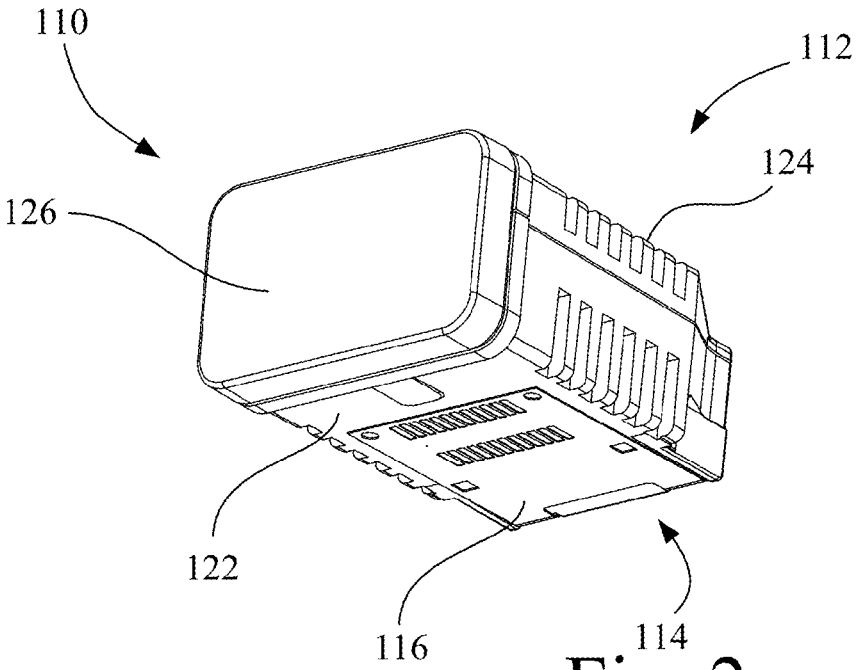
FIG. 2 is another perspective view of the microfluidic dispensing device of FIG. 1.
Figure 3:
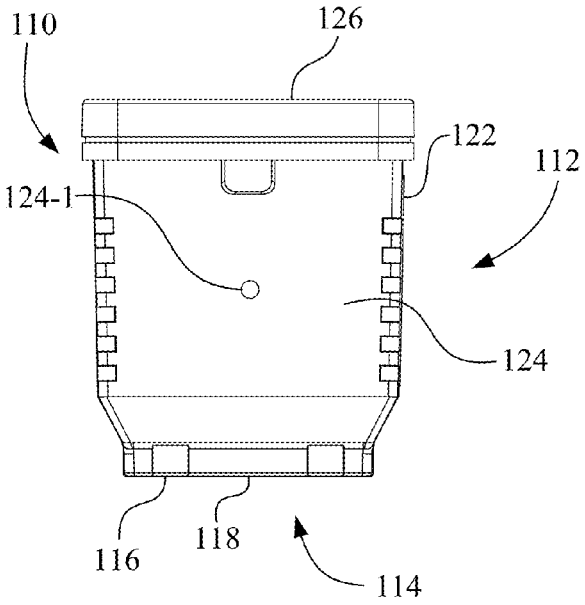
FIG. 3 is a top orthogonal view of the microfluidic dispensing device of FIGS. 1 and 2.
Figure 4:
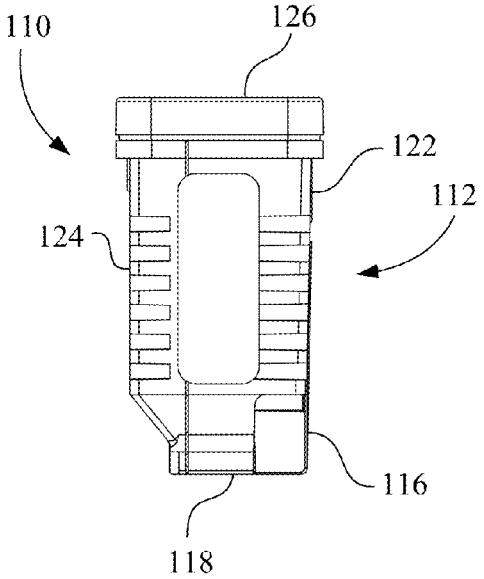
FIG. 4 is a side orthogonal view of the microfluidic dispensing device of FIGS. 1 and 2.
Figure 5:
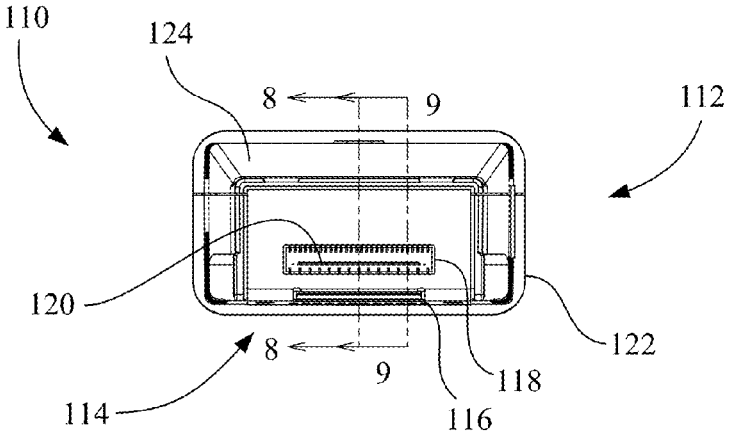
FIG. 5 is an end orthogonal view of the microfluidic dispensing device of FIGS. 1 and 2.

Referring now to the drawings, and more particularly to FIGS. 1-16, there is shown a fluidic dispensing device, which in the present example is a microfluidic dispensing device 110 in accordance with an embodiment of the present invention.

Referring to FIGS. 1-5, microfluidic dispensing device 110 generally includes a housing 112 and a tape automated bonding (TAB) circuit 114. Microfluidic dispensing device 110 is configured to contain a supply of a fluid, such as a fluid containing particulate material, and TAB circuit 114 is configured to facilitate the ejection of the fluid from housing 112. The fluid may be, for example, cosmetics, lubricants, paint, ink, etc.

Figure 6:
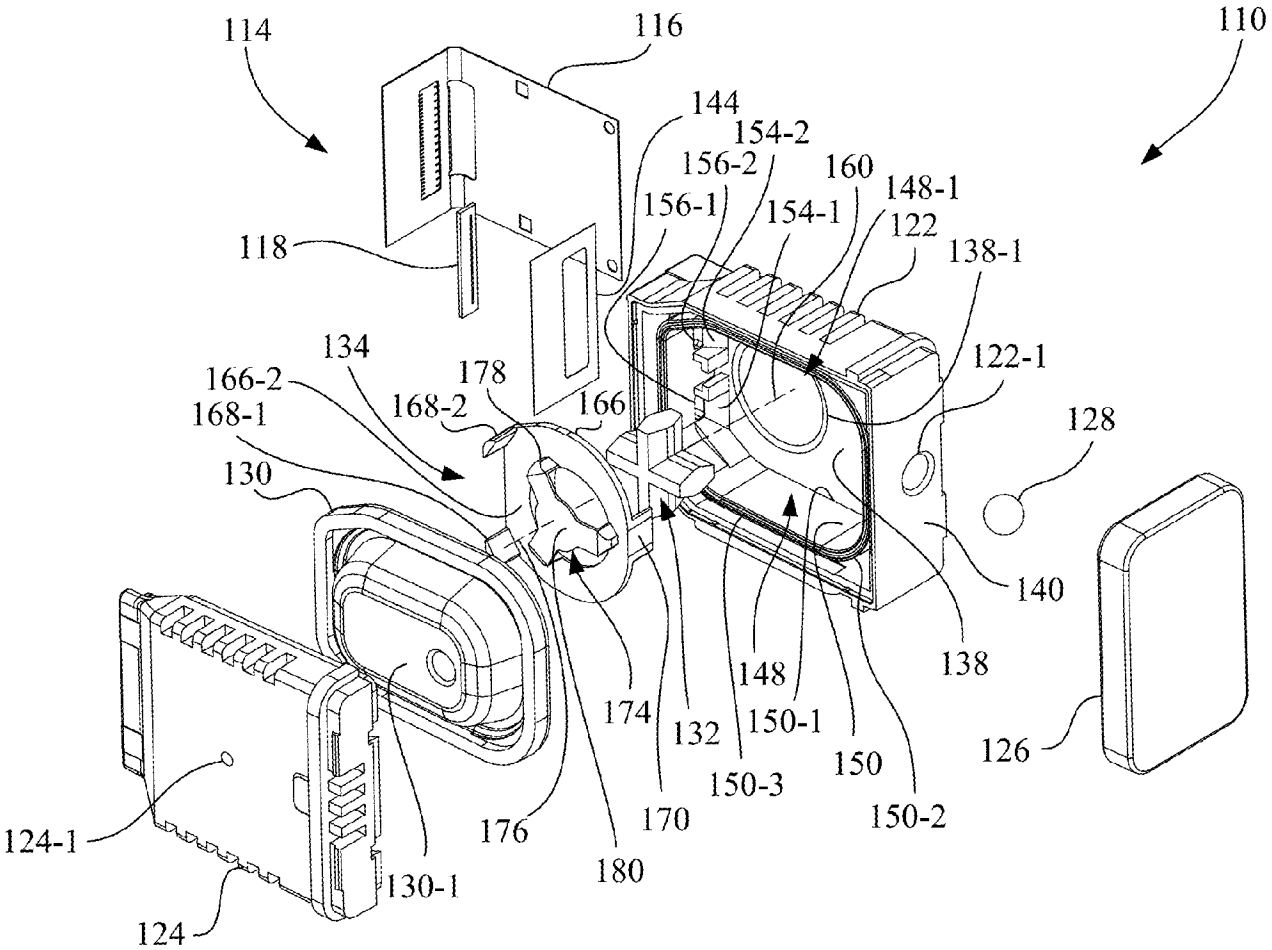
FIG. 6 is an exploded perspective view of the microfluidic dispensing device of FIGS. 1 and 2, oriented for viewing into the chamber of the body in a direction toward the ejection chip.
Figure 7:
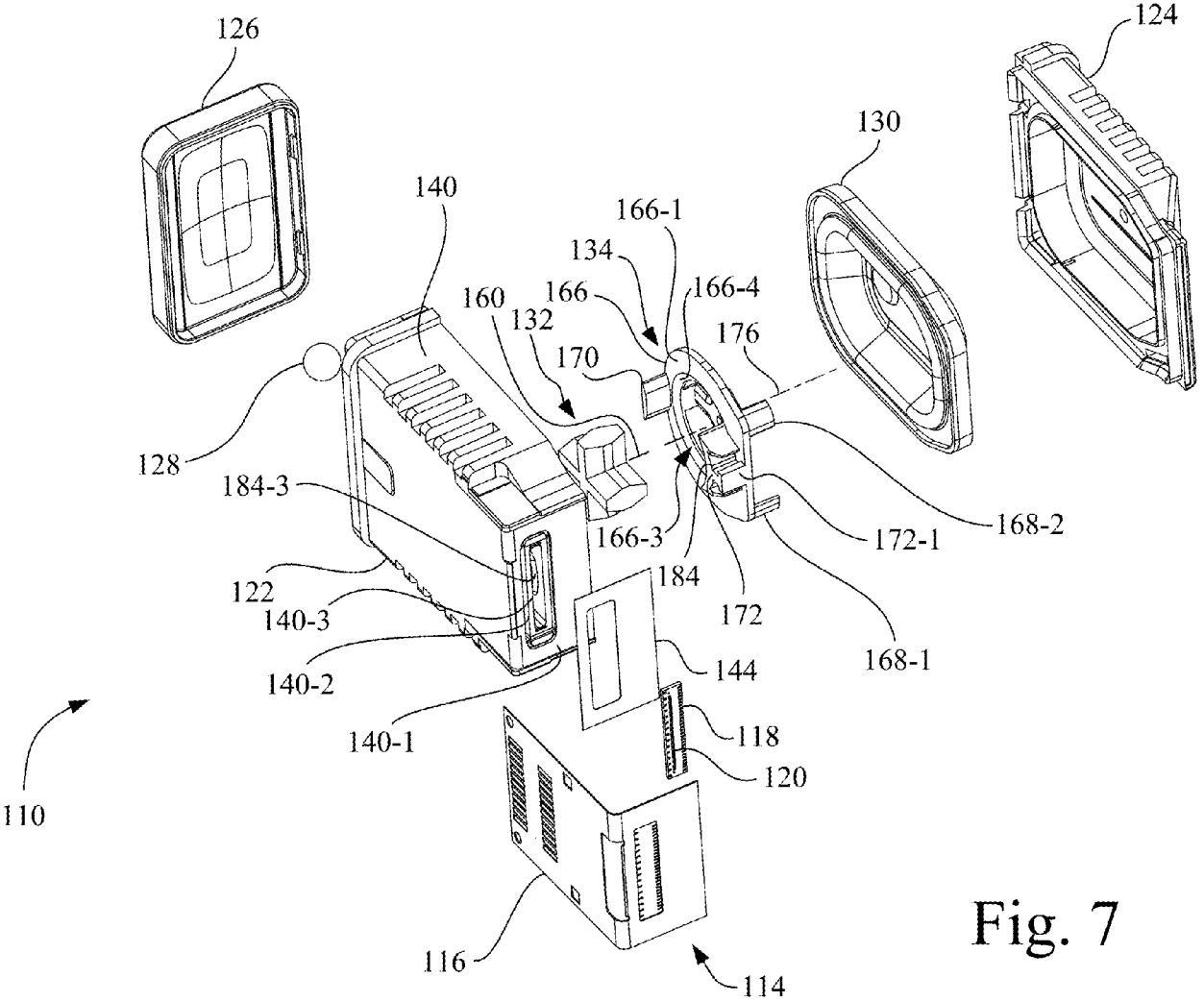
FIG. 7 is another exploded perspective view of the microfluidic dispensing device of FIGS. 1 and 2, oriented for viewing in a direction away from the ejection chip.

Referring also to FIGS. 6 and 7, TAB circuit 114 includes a flex circuit 116 to which an ejection chip 118 is mechanically and electrically connected. Flex circuit 116 provides electrical connection to an electrical driver device (not shown), such as an ink jet printer, configured to operate ejection chip 118 to eject the fluid that is contained within housing 112. In the present embodiment, ejection chip 118 is configured as a plate-like structure having a planar extent formed generally as a nozzle plate layer and a silicon layer, as is well known in the art. The nozzle plate layer of ejection chip 118 has a plurality of ejection nozzles 120 oriented such that a fluid ejection direction 120-1 is substantially orthogonal to the planar extent of ejection chip 118. Associated with each of the ejection nozzles 120, at the silicon layer of ejection chip 118, is an ejection mechanism, such as an electrical heater (thermal) or piezoelectric (electromechanical) device. The operation of such an ejection chip 118 and driver is well known in the micro-fluid ejection arts, such as in ink jet printing.

As used herein, each of the terms substantially orthogonal and substantially perpendicular is defined to mean an angular relationship between two elements of 90 degrees, plus or minus 10 degrees. The term substantially parallel is defined to mean an angular relationship between two elements of zero degrees, plus or minus 10 degrees.

As best shown in FIGS. 6 and 7, housing 112 includes a body 122, a lid 124, an end cap 126, and a fill plug 128 (e.g., ball). Contained within housing 112 is a diaphragm 130, a stir bar 132, and a guide portion 134. Each of the housing 112 components, stir bar 132, and guide portion 134 may be made of plastic, using a molding process. Diaphragm 130 is made of rubber, using a molding process. Also, in the present embodiment, fill plug 128 may be in the form of a stainless steel ball bearing.

Figure 8:
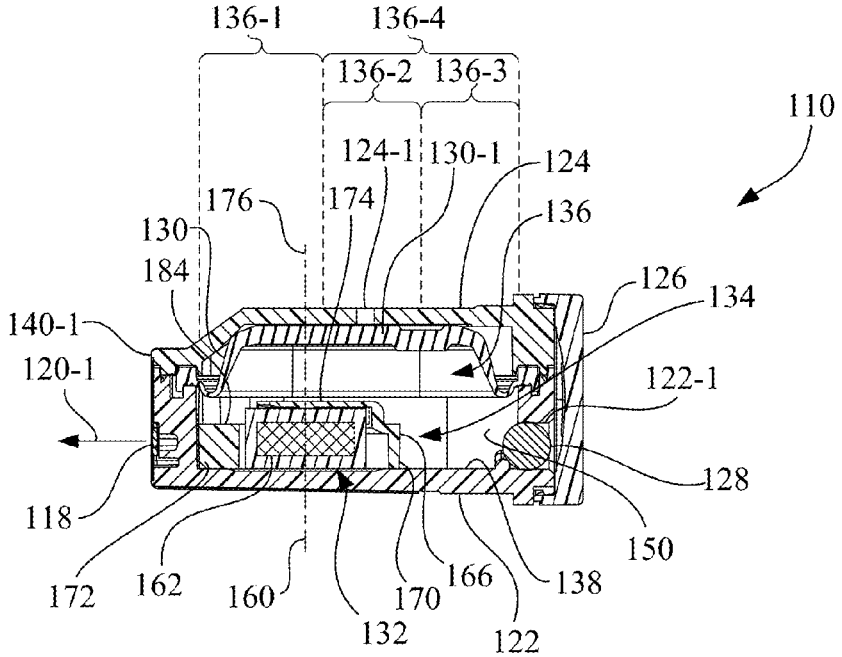
FIG. 8 is a section view of the microfluidic dispensing device of FIG. 1, taken along line 8-8 of FIG. 5.
Figure 9:
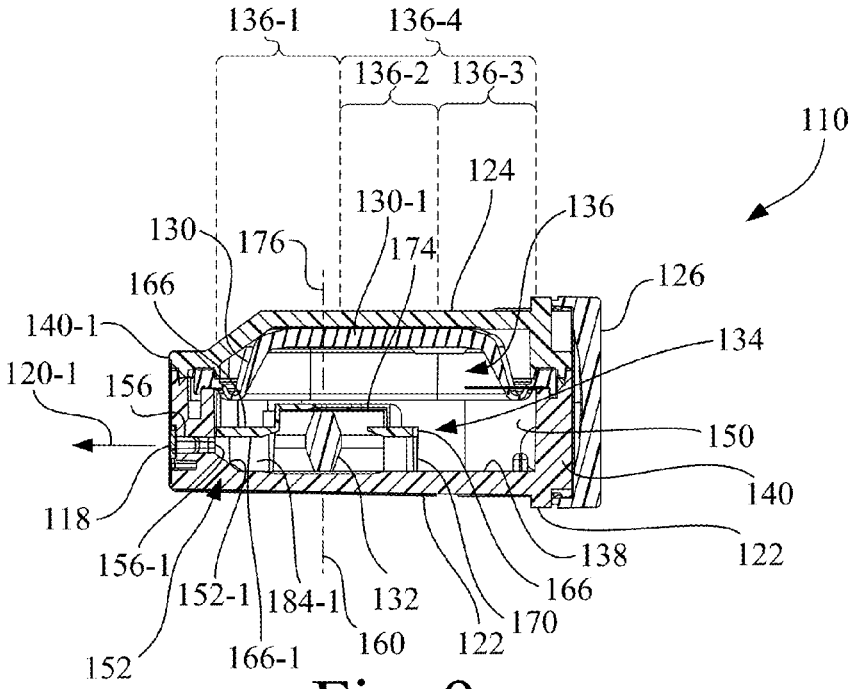
FIG. 9 is a section view of the microfluidic dispensing device of FIG. 1, taken along line 9-9 of FIG. 5.
Figure 10:
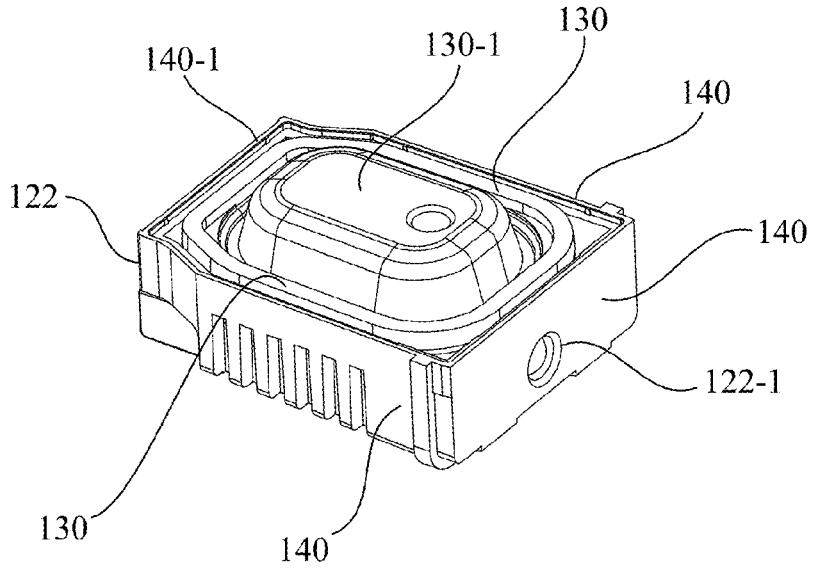
FIG. 10 is a perspective view of the microfluidic dispensing device of FIG. 1, with the end cap and lid removed to expose the body/diaphragm assembly.
Figure 11:
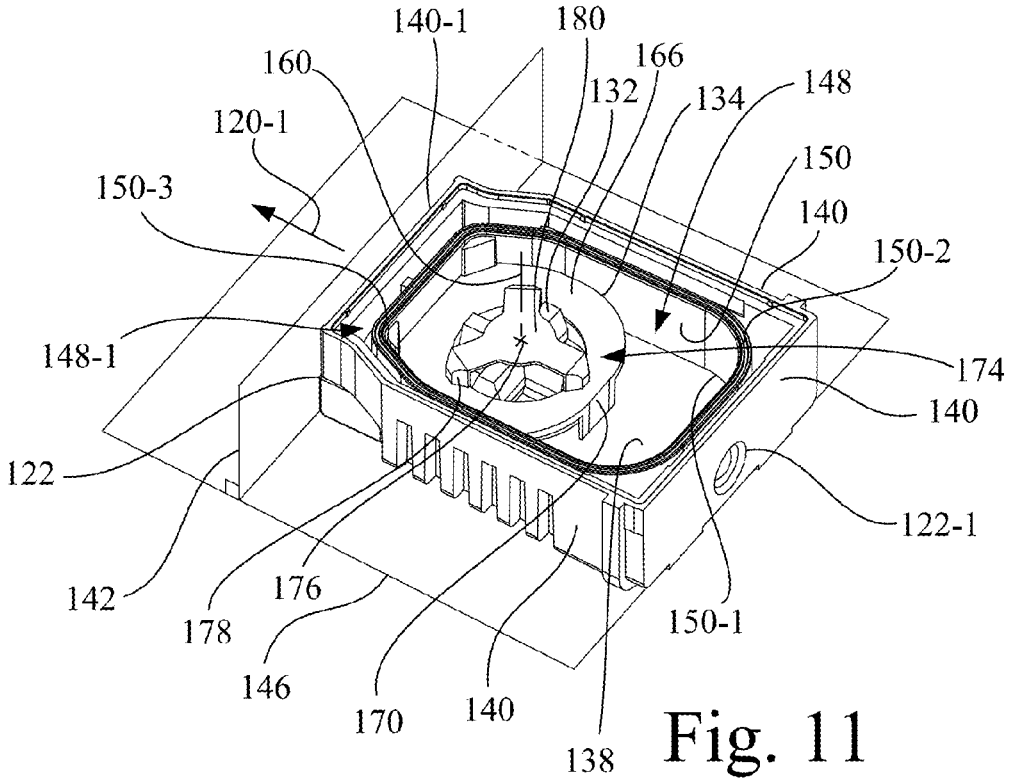
FIG. 11 is a perspective view of the depiction of FIG. 10, with the diaphragm removed to expose the guide portion and stir bar contained in the body, in relation to first and second planes and to the fluid ejection direction.

Referring also to FIGS. 8 and 9, in general, a fluid (not shown) is loaded through a fill hole 122-1 in body 122 (see also FIG. 6) into a sealed region, i.e., a fluid reservoir 136, between body 122 and diaphragm 130. Back pressure in fluid reservoir 136 is set and then maintained by inserting, e.g., pressing, fill plug 128 into fill hole 122-1 to prevent air from leaking into fluid reservoir 136 or fluid from leaking out of fluid reservoir 136. End cap 126 is then placed onto an end of the body 122/lid 124 combination, opposite to ejection chip 118. Stir bar 132 resides in the sealed fluid reservoir 136 between body 122 and diaphragm 130 that contains the fluid. An internal fluid flow may be generated within fluid reservoir 136 by rotating stir bar 132 so as to provide fluid mixing and redistribution of particulate in the fluid within the sealed region of fluid reservoir 136.

Referring now also to FIGS. 10-16, body 122 of housing 112 has a base wall 138 and an exterior perimeter wall 140 contiguous with base wall 138. Exterior perimeter wall 140 is oriented to extend from base wall 138 in a direction that is substantially orthogonal to base wall 138. Lid 124 is configured to engage exterior perimeter wall 140. Thus, exterior perimeter wall 140 is interposed between base wall 138 and lid 124, with lid 124 being attached to the open free end of exterior perimeter wall 140 by weld, adhesive, or other fastening mechanism, such as a snap fit or threaded union. Attachment of lid 124 to body 122 occurs after installation of diaphragm 130, stir bar 132, and guide portion 134 in body 122.

Figure 16:
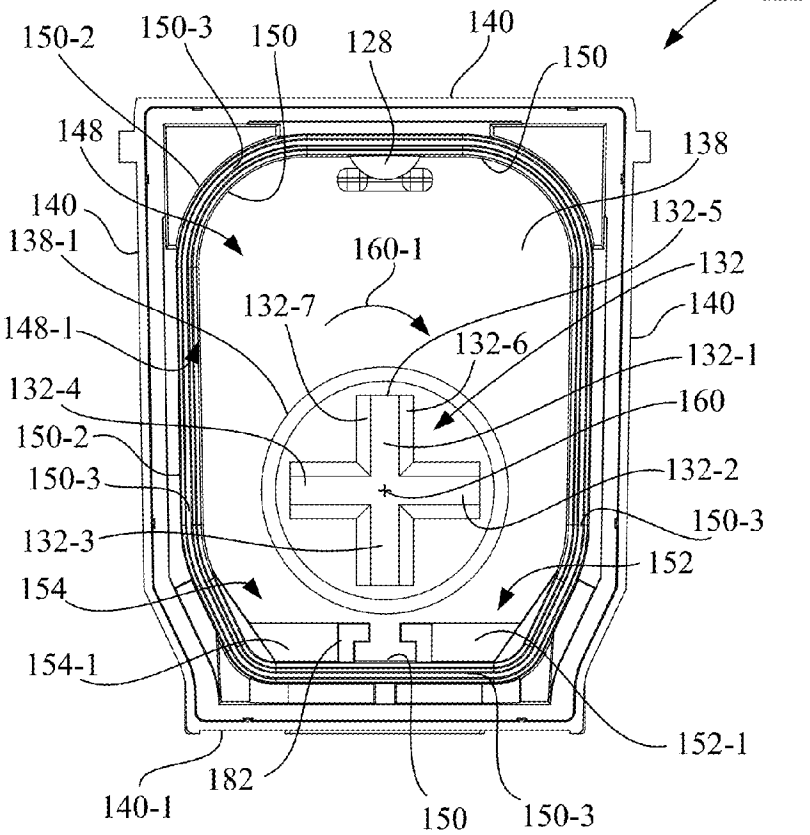
FIG. 16 is an enlarged view of the depiction of FIG. 12, with the guide portion removed to expose the stir bar residing in the chamber of the body.
Figure 15:
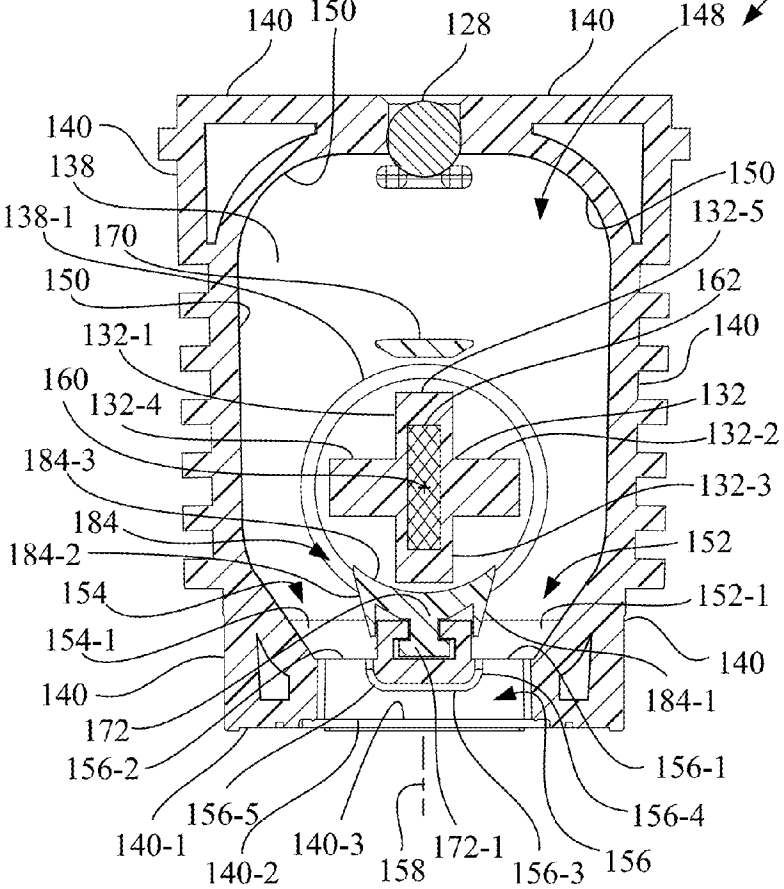
FIG. 15 is an enlarged section view of the body/guide portion/stir bar arrangement of FIGS. 12 and 13, taken along line 15-15 of FIG. 13.

Exterior perimeter wall 140 of body 122 includes an exterior wall 140-1, which is a contiguous portion of exterior perimeter wall 140. Exterior wall 140-1 has a chip mounting surface 140-2 that defines a plane 142 (see FIGS. 11 and 12), and has a fluid opening 140-3 adjacent to chip mounting surface 140-2 that passes through the thickness of exterior wall 140-1. Ejection chip 118 is mounted, e.g., by an adhesive sealing strip 144 (see FIGS. 6 and 7), to chip mounting surface 140-2 and is in fluid communication with fluid opening 140-3 (see FIG. 13) of exterior wall 140-1. Thus, the planar extent of ejection chip 118 is oriented along plane 142, with the plurality of ejection nozzles 120 oriented such that the fluid ejection direction 120-1 is substantially orthogonal to plane 142. Base wall 138 is oriented along a plane 146 (see FIG. 11) that is substantially orthogonal to plane 142 of exterior wall 140-1. As best shown in FIGS. 6, 15 and 16, base wall 138 may include a circular recessed region 138-1 in the vicinity of the desired location of stir bar 132.

Referring to FIGS. 11-16, body 122 of housing 112 also includes a chamber 148 located within a boundary defined by exterior perimeter wall 140. Chamber 148 forms a portion of fluid reservoir 136, and is configured to define an interior space, and in particular, includes base wall 138 and has an interior perimetrical wall 150 configured to have rounded corners, so as to promote fluid flow in chamber 148. Interior perimetrical wall 150 of chamber 148 has an extent bounded by a proximal end 150-1 and a distal end 150-2. Proximal end 150-1 is contiguous with, and may form a transition radius with, base wall 138. Such an edge radius may help in mixing effectiveness by reducing the number of sharp corners. Distal end 150-2 is configured to define a perimetrical end surface 150-3 at a lateral opening 148-1 of chamber 148. Perimetrical end surface 150-3 may include a plurality of perimetrical ribs, or undulations, to provide an effective sealing surface for engagement with diaphragm 130. The extent of interior perimetrical wall 150 of chamber 148 is substantially orthogonal to base wall 138, and is substantially parallel to the corresponding extent of exterior perimeter wall 140 (see FIG. 6).

As best shown in FIGS. 15 and 16, chamber 148 has an inlet fluid port 152 and an outlet fluid port 154, each of which is formed in a portion of interior perimetrical wall 150. The terms "inlet" and "outlet" are terms of convenience that are used in distinguishing between the multiple ports of the present embodiment, and are correlated with a particular rotational direction of stir bar 132. However, it is to be understood that it is the rotational direction of stir bar 132 that dictates whether a particular port functions as an inlet port or an outlet port, and it is within the scope of this invention to reverse the rotational direction of stir bar 132, and thus reverse the roles of the respective ports within chamber 148.

Inlet fluid port 152 is separated a distance from outlet fluid port 154 along a portion of interior perimetrical wall 150. As best shown in FIGS. 15 and 16, considered together, body 122 of housing 112 includes a fluid channel 156 interposed between the portion of interior perimetrical wall 150 of chamber 148 and exterior wall 140-1 of exterior perimeter wall 140 that carries ejection chip 118.

Fluid channel 156 is configured to minimize particulate settling in a region of ejection chip 118. Fluid channel 156 is sized, e.g., using empirical data, to provide a desired flow rate while also maintaining an acceptable fluid velocity for fluid mixing through fluid channel 156.

In the present embodiment, referring to FIG. 15, fluid channel 156 is configured as a U-shaped elongated passage having a channel inlet 156-1 and a channel outlet 156-2. Fluid channel 156 dimensions, e.g., height and width, and shape are selected to provide a desired combination of fluid flow and fluid velocity for facilitating intra-channel stirring.

Fluid channel 156 is configured to connect inlet fluid port 152 of chamber 148 in fluid communication with outlet fluid port 154 of chamber 148, and also connects fluid opening 140-3 of exterior wall 140-1 of exterior perimeter wall 140 in fluid communication with both inlet fluid port 152 and outlet fluid port 154 of chamber 148. In particular, channel inlet 156-1 of fluid channel 156 is located adjacent to inlet fluid port 152 of chamber 148 and channel outlet 156-2 of fluid channel 156 is located adjacent to outlet fluid port 154 of chamber 148. In the present embodiment, the structure of inlet fluid port 152 and outlet fluid port 154 of chamber 148 is symmetrical.

Fluid channel 156 has a convexly arcuate wall 156-3 that is positioned between channel inlet 156-1 and channel outlet 156-2, with fluid channel 156 being symmetrical about a channel mid-point 158. In turn, convexly arcuate wall 156-3 of fluid channel 156 is positioned between inlet fluid port 152 and outlet fluid port 154 of chamber 148 on the opposite side of interior perimetrical wall 150 from the interior space of chamber 148, with convexly arcuate wall 156-3 positioned to face fluid opening 140-3 of exterior wall 140-1 and ejection chip 118.

Convexly arcuate wall 156-3 is configured to create a fluid flow through fluid channel 156 that is substantially parallel to ejection chip 118. In the present embodiment, a longitudinal extent of convexly arcuate wall 156-3 has a radius that faces fluid opening 140-3 and that is substantially parallel to ejection chip 118, and has transition radii 156-4, 156-5 located adjacent to channel inlet 156-1 and channel outlet 156-2, respectively. The radius and transition radii 156-4, 156-5 of convexly arcuate wall 156-3 help with fluid flow efficiency. A distance between convexly arcuate wall 156-3 and fluid ejection chip 118 is narrowest at the channel mid-point 158, which coincides with a mid-point of the longitudinal extent of ejection chip 118, and in turn, with a mid-point of the longitudinal extent of fluid opening 140-3 of exterior wall 140-1.

Each of inlet fluid port 152 and outlet fluid port 154 of chamber 148 has a beveled ramp structure configured such that each of inlet fluid port 152 and outlet fluid port 154 converges in a respective direction toward fluid channel 156. In particular, inlet fluid port 152 of chamber 148 has a beveled inlet ramp 152-1 configured such that inlet fluid port 152 converges, i.e., narrows, in a direction toward channel inlet 156-1 of fluid channel 156, and outlet fluid port 154 of chamber 148 has a beveled outlet ramp 154-1 that diverges, i.e., widens, in a direction away from channel outlet 156-2 of fluid channel 156.

Referring again to FIGS. 6-10, diaphragm 130 is positioned between lid 124 and perimetrical end surface 150-3 of interior perimetrical wall 150 of chamber 148. The attachment of lid 124 to body 122 compresses a perimeter of diaphragm 130 thereby creating a continuous seal between diaphragm 130 and body 122. More particularly, diaphragm 130 is configured for sealing engagement with perimetrical end surface 150-3 of interior perimetrical wall 150 of chamber 148 in forming fluid reservoir 136. Thus, in combination, chamber 148 and diaphragm 130 cooperate to define fluid reservoir 136 having a variable volume.

Referring particularly to FIGS. 6, 8 and 9, an exterior surface of diaphragm 130 is vented to the atmosphere through a vent hole 124-1 located in lid 124 so that a controlled negative pressure can be maintained in fluid reservoir 136. Diaphragm 130 is made of rubber, and includes a dome portion 130-1 configured to progressively collapse toward base wall 138 as fluid is depleted from microfluidic dispensing device 110, so as to maintain a desired negative pressure in chamber 148, and thus changing the effective volume of the variable volume of fluid reservoir 136.

Referring to FIGS. 8 and 9, for sake of further explanation, below, the variable volume of fluid reservoir 136, also referred to herein as a bulk region, may be considered to have a proximal continuous ⅓ volume portion 136-1, and a continuous ⅔ volume portion 136-4 that is formed from a central continuous ⅓ volume portion 136-2 and a distal continuous ⅓ volume portion 136-3, with the central continuous ⅓ volume portion 136-2 separating the proximal continuous ⅓ volume portion 136-1 from the distal continuous ⅓ volume portion 136-3. The proximal continuous ⅓ volume portion 136-1 is located closer to ejection chip 118 than the continuous ⅔ volume portion 136-4 that is formed from the central continuous ⅓ volume portion 136-2 and the distal continuous ⅓ volume portion 136-3.

Referring to FIGS. 6-9 and 16, stir bar 132 resides in the variable volume of fluid reservoir 136 and chamber 148, and is located within a boundary defined by the interior perimetrical wall 150 of chamber 148. Stir bar 132 has a rotational axis 160 and a plurality of paddles 132-1, 132-2, 132-3, 132-4 that radially extend away from the rotational axis 160. Stir bar 132 has a magnet 162 (see FIG. 8), e.g., a permanent magnet, configured for interaction with an external magnetic field generator 164 (see FIG. 1) to drive stir bar 132 to rotate around the rotational axis 160. The principle of stir bar 132 operation is that as magnet 162 is aligned to a strong enough external magnetic field generated by external magnetic field generator 164, then rotating the external magnetic field generated by external magnetic field generator 164 in a controlled manner will rotate stir bar 132. The external magnetic field generated by external magnetic field generator 164 may be rotated electronically, akin to the operation of a stepper motor, or may be rotated via a rotating shaft. Thus, stir bar 132 is effective to provide fluid mixing in fluid reservoir 136 by the rotation of stir bar 132 around the rotational axis 160.

Fluid mixing in the bulk region relies on a flow velocity caused by rotation of stir bar 132 to create a shear stress at the settled boundary layer of the particulate. When the shear stress is greater than the critical shear stress (empirically determined) to start particle movement, remixing occurs because the settled particles are now distributed in the moving fluid. The shear stress is dependent on both the fluid parameters such as: viscosity, particle size, and density; and mechanical design factors such as: container shape, stir bar 132 geometry, fluid thickness between moving and stationary surfaces, and rotational speed.

Also, a fluid flow is generated by rotating stir bar 132 in a fluid region, e.g., the proximal continuous ⅓ volume portion 136-1 and fluid channel 156, associated with ejection chip 118, so as to ensure that mixed bulk fluid is presented to ejection chip 118 for nozzle ejection and to move fluid adjacent to ejection chip 118 to the bulk region of fluid reservoir 136 to ensure that the channel fluid flowing through fluid channel 156 mixes with the bulk fluid of fluid reservoir 136, so as to produce a more uniform mixture. Although this flow is primarily distribution in nature, some mixing will occur if the flow velocity is sufficient to create a shear stress above the critical value.

Stir bar 132 primarily causes rotation flow of the fluid about a central region associated with the rotational axis 160 of stir bar 132, with some axial flow with a central return path as in a partial toroidal flow pattern.

Referring to FIG. 16, each paddle of the plurality of paddles 132-1, 132-2, 132-3, 132-4 of stir bar 132 has a respective free end tip 132-5. To reduce rotational drag, each paddle may include upper and lower symmetrical pairs of chamfered surfaces, forming leading beveled surfaces 132-6 and trailing beveled surfaces 132-7 relative to a rotational direction 160-1 of stir bar 132. It is also contemplated that each of the plurality of paddles 132-1, 132-2, 132-3, 132-4 of stir bar 132 may have a pill or cylindrical shape. In the present embodiment, stir bar 132 has two pairs of diametrically opposed paddles, wherein a first paddle of the diametrically opposed paddles has a first free end tip 132-5 and a second paddle of the diametrically opposed paddles has a second free end tip 132-5.

In the present embodiment, the four paddles forming the two pairs of diametrically opposed paddles are equally spaced at 90 degree increments around the rotational axis 160. However, the actual number of paddles of stir bar 132 may be two or more, and preferably three or four, but more preferably four, with each adjacent pair of paddles having the same angular spacing around the rotational axis 160. For example, a stir bar 132 configuration having three paddles may have a paddle spacing of 120 degrees, having four paddles may have a paddle spacing of 90 degrees, etc.

In the present embodiment, and with the variable volume of fluid reservoir 136 being divided as the proximal continuous ⅓ volume portion 136-1 and the continuous ⅔ volume portion 136-4 described above, with the proximal continuous ⅓ volume portion 136-1 being located closer to ejection chip 118 than the continuous ⅔ volume portion 136-4, the rotational axis 160 of stir bar 132 may be located in the proximal continuous ⅓ volume portion 136-1 that is closer to ejection chip 118. Stated differently, guide portion 134 is configured to position the rotational axis 160 of stir bar 132 in a portion of the interior space of chamber 148 that constitutes a ⅓ of the volume of the interior space of chamber 148 that is closest to fluid opening 140-3.

Referring again also to FIG. 11, the rotational axis 160 of stir bar 132 may be oriented in an angular range of perpendicular, plus or minus 45 degrees, relative to the fluid ejection direction 120-1. Stated differently, the rotational axis 160 of stir bar 132 may be oriented in an angular range of parallel, plus or minus 45 degrees, relative to the planar extent (e.g., plane 142) of ejection chip 118. In combination, the rotational axis 160 of stir bar 132 may be oriented in both an angular range of perpendicular, plus or minus 45 degrees, relative the fluid ejection direction 120-1, and an angular range of parallel, plus or minus 45 degrees, relative to the planar extent of ejection chip 118.

More preferably, the rotational axis 160 has an orientation substantially perpendicular to the fluid ejection direction 120-1, and thus, the rotational axis 160 of stir bar 132 has an orientation that is substantially parallel to plane 142, i.e., planar extent, of ejection chip 118 and that is substantially perpendicular to plane 146 of base wall 138. Also, in the present embodiment, the rotational axis 160 of stir bar 132 has an orientation that is substantially perpendicular to plane 146 of base wall 138 in all orientations around rotational axis 160 and is substantially perpendicular to the fluid ejection direction 120-1.

Referring to FIGS. 6-9, 11, and 12, the orientations of stir bar 132, described above, may be achieved by guide portion 134, with guide portion 134 also being located within chamber 148 in the variable volume of fluid reservoir 136 (see FIGS. 8 and 9), and more particularly, within the boundary defined by interior perimetrical wall 150 of chamber 148. Guide portion 134 is configured to confine stir bar 132 in a predetermined portion of the interior space of chamber 148 at a predefined orientation, as well as to split and redirect the rotational fluid flow from stir bar 132 towards channel inlet 156-1 of fluid channel 156. On the return flow side, guide portion 134 helps to recombine the rotational flow received from channel outlet 156-2 of fluid channel 156 in the bulk region of fluid reservoir 136.

For example, guide portion 134 may be configured to position the rotational axis 160 of stir bar 132 in an angular range of parallel, plus or minus 45 degrees, relative to the planar extent of ejection chip 118, and more preferably, guide portion 134 is configured to position the rotational axis 160 of stir bar 132 substantially parallel to the planar extent of ejection chip 118. In the present embodiment, guide portion 134 is configured to position and maintain an orientation of the rotational axis 160 of stir bar 132 to be substantially parallel to the planar extent of ejection chip 118 and to be substantially perpendicular to plane 146 of base wall 138 in all orientations around rotational axis 160.

Guide portion 134 includes an annular member 166, a plurality of locating features 168-1, 168-2, offset members 170, 172, and a cage structure 174. The plurality of locating features 168-1, 168-2 are positioned on the opposite side of annular member 166 from offset members 170, 172, and are positioned to be engaged by diaphragm 130, which keeps offset members 170, 172 in contact with base wall 138. Offset members 170, 172 maintain an axial position (relative to the rotational axis 160 of stir bar 132) of guide portion 134 in fluid reservoir 136. Offset member 172 includes a retention feature 172-1 that engages body 122 to prevent a lateral translation of guide portion 134 in fluid reservoir 136.

Referring again to FIGS. 6 and 7, annular member 166 of guide portion 134 has a first annular surface 166-1, a second annular surface 166-2, and an opening 166-3 that defines an annular confining surface 166-4. Opening 166-3 of annular member 166 has a central axis 176. Annular confining surface 166-4 is configured to limit radial movement of stir bar 132 relative to the central axis 176. Second annular surface 166-2 is opposite first annular surface 166-1, with first annular surface 166-1 being separated from second annular surface 166-2 by annular confining surface 166-4. Referring also to FIG. 9, first annular surface 166-1 of annular member 166 also serves as a continuous ceiling over, and between, inlet fluid port 152 and outlet fluid port 154. The plurality of offset members 170, 172 are coupled to annular member 166, and more particularly, the plurality of offset members 170, 172 are connected to first annular surface 166-1 of annular member 166. The plurality of offset members 170, 172 are positioned to extend from annular member 166 in a first axial direction relative to the central axis 176. Each of the plurality of offset members 170, 172 has a free end configured to engage base wall 138 of chamber 148 to establish an axial offset of annular member 166 from base wall 138. Offset member 172 also is positioned and configured to aid in preventing a flow bypass of fluid channel 156.

The plurality of offset members 170, 172 are coupled to annular member 166, and more particularly, the plurality of offset members 170, 172 are connected to second annular surface 166-2 of annular member 166. The plurality of offset members 170, 172 are positioned to extend from annular member 166 in a second axial direction relative to the central axis 176, opposite to the first axial direction.

Thus, when assembled, each of locating features 168-1, 168-2 has a free end that engages a perimetrical portion of diaphragm 130, and each of the plurality of offset members 170, 172 have a free end that engages base wall 138.

Figure 12:
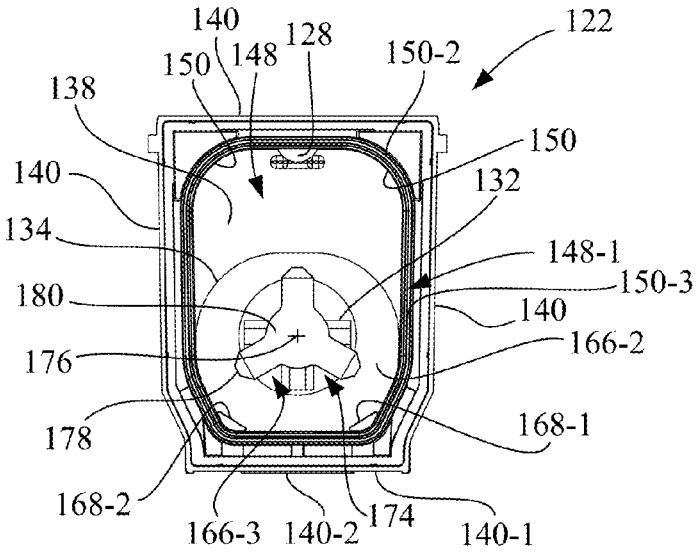
FIG. 12 is an orthogonal view of the body/guide portion/stir bar arrangement of FIG. 11, as viewed in a direction into the body of the chamber toward the base wall of the body.
Figure 13:
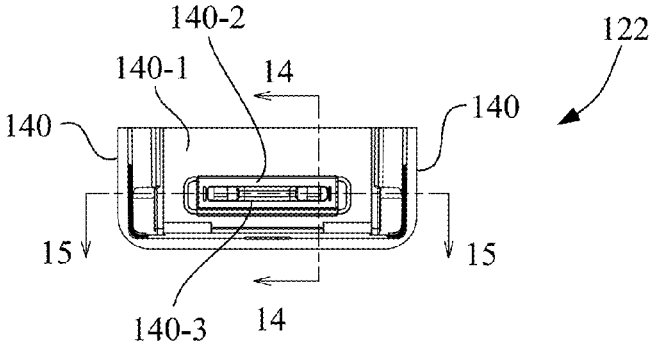
FIG. 13 is an orthogonal end view of the body of FIG. 11, which contains the guide portion and stir bar, as viewed in a direction toward the exterior wall and fluid opening of the body.

Cage structure 174 of guide portion 134 is coupled to annular member 166 opposite to the plurality of offset members 170, 172, and more particularly, the cage structure 174 has a plurality of offset legs 178 connected to second annular surface 166-2 of annular member 166. Cage structure 174 has an axial restraint portion 180 that is axially displaced by the plurality of offset legs 178 (three, as shown) from annular member 166 in the second axial direction opposite to the first axial direction. As shown in FIG. 12, axial restraint portion 180 is positioned over at least a portion of the opening 166-3 in annular member 166 to limit axial movement of stir bar 132 relative to the central axis 176 in the second axial direction. Cage structure 174 also serves to prevent diaphragm 130 from contacting stir bar 132 as diaphragm displacement (collapse) occurs during fluid depletion from fluid reservoir 136.

As such, in the present embodiment, stir bar 132 is confined within the region defined by opening 166-3 and annular confining surface 166-4 of annular member 166, and between axial restraint portion 180 of the cage structure 174 and base wall 138 of chamber 148. The extent to which stir bar 132 is movable within fluid reservoir 136 is determined by the radial tolerances provided between annular confining surface 166-4 and stir bar 132 in the radial direction, and by the axial tolerances between stir bar 132 and the axial limit provided by the combination of base wall 138 and axial restraint portion 180. For example, the tighter the radial and axial tolerances provided by guide portion 134, the less variation of the rotational axis 160 of stir bar 132 from perpendicular relative to base wall 138, and the less side-to-side motion of stir bar 132 within fluid reservoir 136.

In the present embodiment, guide portion 134 is configured as a unitary insert member that is removably attached to housing 112. Guide portion 134 includes retention feature 172-1 and body 122 of housing 112 includes a second retention feature 182. First retention feature 172-1 is engaged with second retention feature 182 to attach guide portion 134 to body 122 of housing 112 in a fixed relationship with housing 112. The first retention feature 172-1/second retention feature 182 may be, for example, in the form of a tab/slot arrangement, or alternatively, a slot/tab arrangement, respectively.

Referring to FIGS. 7 and 15, guide portion 134 may further include a flow control portion 184, which in the present embodiment, also serves as offset member 172. Referring to FIG. 15, flow control portion 184 has a flow separator feature 184-1, a flow rejoining feature 184-2, and a concavely arcuate surface 184-3. Concavely arcuate surface 184-3 is coextensive with, and extends between, each of flow separator feature 184-1 and flow rejoining feature 184-2. Each of flow separator feature 184-1 and flow rejoining feature 184-2 is defined by a respective angled, i.e., beveled, wall. Flow separator feature 184-1 is positioned adjacent inlet fluid port 152 and flow rejoining feature 184-2 is positioned adjacent outlet fluid port 154.

Figure 14:
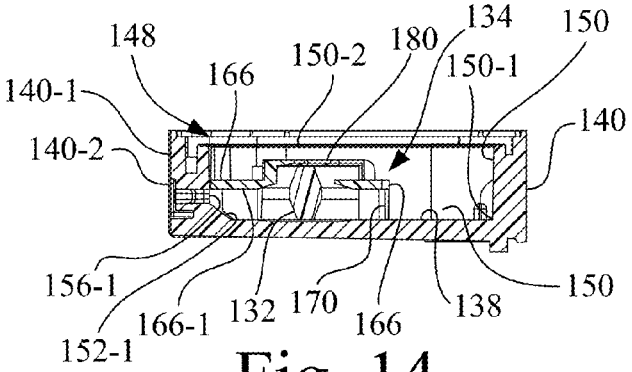
FIG. 14 is a section view of the body/guide portion/stir bar arrangement of FIGS. 12 and 13, taken along line 14-14 of FIG. 13.

The beveled wall of flow separator feature 184-1 positioned adjacent to inlet fluid port 152 of chamber 148 cooperates with beveled inlet ramp 152-1 of inlet fluid port 152 of chamber 148 to guide fluid toward channel inlet 156-1 of fluid channel 156. Flow separator feature 184-1 is configured such that the rotational flow is directed toward channel inlet 156-1 instead of allowing a direct bypass of fluid into the outlet fluid that exits channel outlet 156-2. Referring also to FIGS. 9 and 14, positioned opposite beveled inlet ramp 152-1 is the fluid ceiling provided by first annular surface 166-1 of annular member 166. Flow separator feature 184-1 in combination with the continuous ceiling of annular member 166 and beveled ramp wall provided by beveled inlet ramp 152-1 of inlet fluid port 152 of chamber 148 aids in directing a fluid flow into channel inlet 156-1 of fluid channel 156.

Likewise, referring to FIGS. 9, 14 and 15, the beveled wall of flow rejoining feature 184-2 positioned adjacent to outlet fluid port 154 of chamber 148 cooperates with beveled outlet ramp 154-1 of outlet fluid port 154 to guide fluid away from channel outlet 156-2 of fluid channel 156. Positioned opposite beveled outlet ramp 154-1 is the fluid ceiling provided by first annular surface 166-1 of annular member 166.

In the present embodiment, flow control portion 184 is a unitary structure formed as offset member 172 of guide portion 134. Alternatively, all or a portion of flow control portion 184 may be incorporated into interior perimetrical wall 150 of chamber 148 of body 122 of housing 112.

In the present embodiment, as best shown in FIGS. 15 and 16, stir bar 132 is oriented such that the plurality of paddles 132-1, 132-2, 132-3, 132-4 periodically face the concavely arcuate surface 184-3 of the flow control portion 184 as stir bar 132 is rotated about the rotational axis 160. Stir bar 132 has a stir bar radius from rotational axis 160 to the free end tip 132-5 of a respective paddle. A ratio of the stir bar radius and a clearance distance between the free end tip 132-5 and flow control portion 184 may be 5:2 to 5:0.025. More particularly, guide portion 134 is configured to confine stir bar 132 in a predetermined portion of the interior space of chamber 148. In the present example, a distance between the respective free end tip 132-5 of each of the plurality of paddles 132-1, 132-2, 132-3, 132-4 and concavely arcuate surface 184-3 of flow control portion 184 is in a range of 2.0 millimeters to 0.1 millimeters, and more preferably, is in a range of 1.0 millimeters to 0.1 millimeters, as the respective free end tip 132-5 faces concavely arcuate surface 184-3. Also, it has been found that it is preferred to position stir bar 132 as close to ejection chip 118 as possible so as to maximize flow through fluid channel 156.

Also, guide portion 134 is configured to position the rotational axis 160 of stir bar 132 in a portion of fluid reservoir 136 such that the free end tip 132-5 of each of the plurality of paddles 132-1, 132-2, 132-3, 132-4 of stir bar 132 rotationally ingresses and egresses a proximal continuous ⅓ volume portion 136-1 that is closer to ejection chip 118. Stated differently, guide portion 134 is configured to position the rotational axis 160 of stir bar 132 in a portion of the interior space such that the free end tip 132-5 of each of the plurality of paddles 132-1, 132-2, 132-3, 132-4 rotationally ingresses and egresses the continuous ⅓ volume portion 136-1 of the interior space of chamber 148 that includes inlet fluid port 152 and outlet fluid port 154.

More particularly, in the present embodiment, wherein stir bar 132 has four paddles, guide portion 134 is configured to position the rotational axis 160 of stir bar 132 in a portion of the interior space such that the first and second free end tips 132-5 of each the two pairs of diametrically opposed paddles 132-1, 132-3 and 132-2, 132-4 alternatingly and respectively are positioned in the proximal continuous ⅓ volume portion 136-1 of the volume of the interior space of chamber 148 that includes inlet fluid port 152 and outlet fluid port 154 and in the continuous ⅔ volume portion 136-4 having the distal continuous ⅓ volume portion 136-3 of the interior space that is furthest from ejection chip 118.

FIGS. 17-27 depict another embodiment of the invention, which in the present example is in the form of a microfluidic dispensing device 210. Elements common to both microfluidic dispensing device 110 and microfluidic dispensing device 210 are identified using common element numbers, and for brevity, are not described again below in full detail.

Microfluidic dispensing device 210 generally includes a housing 212 and TAB circuit 114, with microfluidic dispensing device 210 configured to contain a supply of a fluid, such as a particulate carrying fluid, and with TAB circuit 114 configured to facilitate the ejection of the fluid from housing 212.

Figure 17:
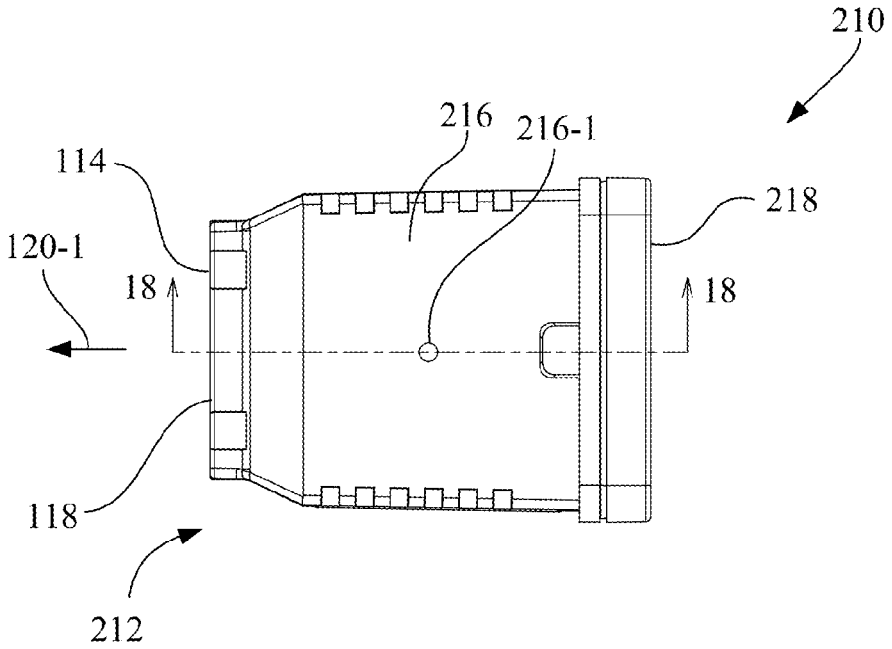
FIG. 17 is a top view of another embodiment of a microfluidic dispensing device in accordance with the present invention.
Figure 18:
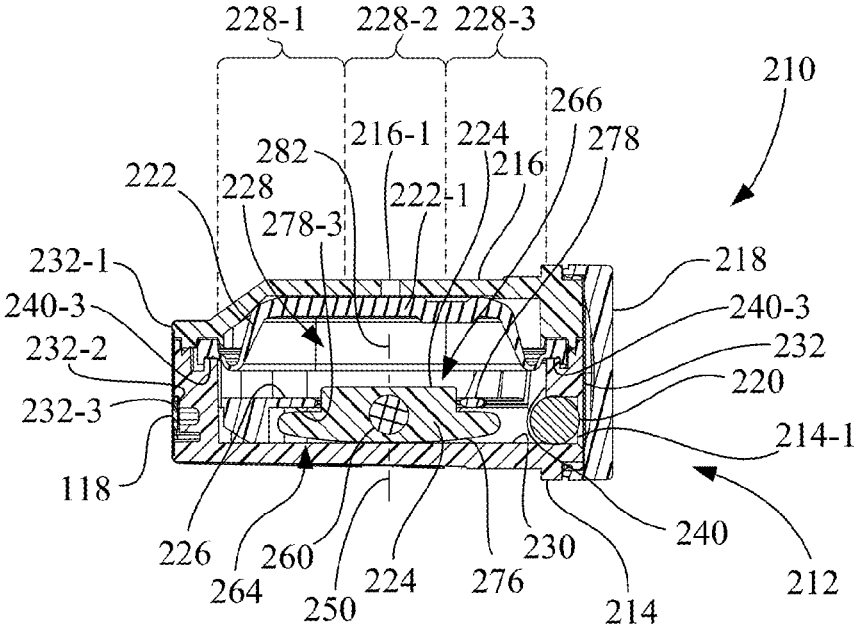
FIG. 18 is a section view of the microfluidic dispensing device of FIG. 17, taken along line 18-18 of FIG. 17.
Figure 19:
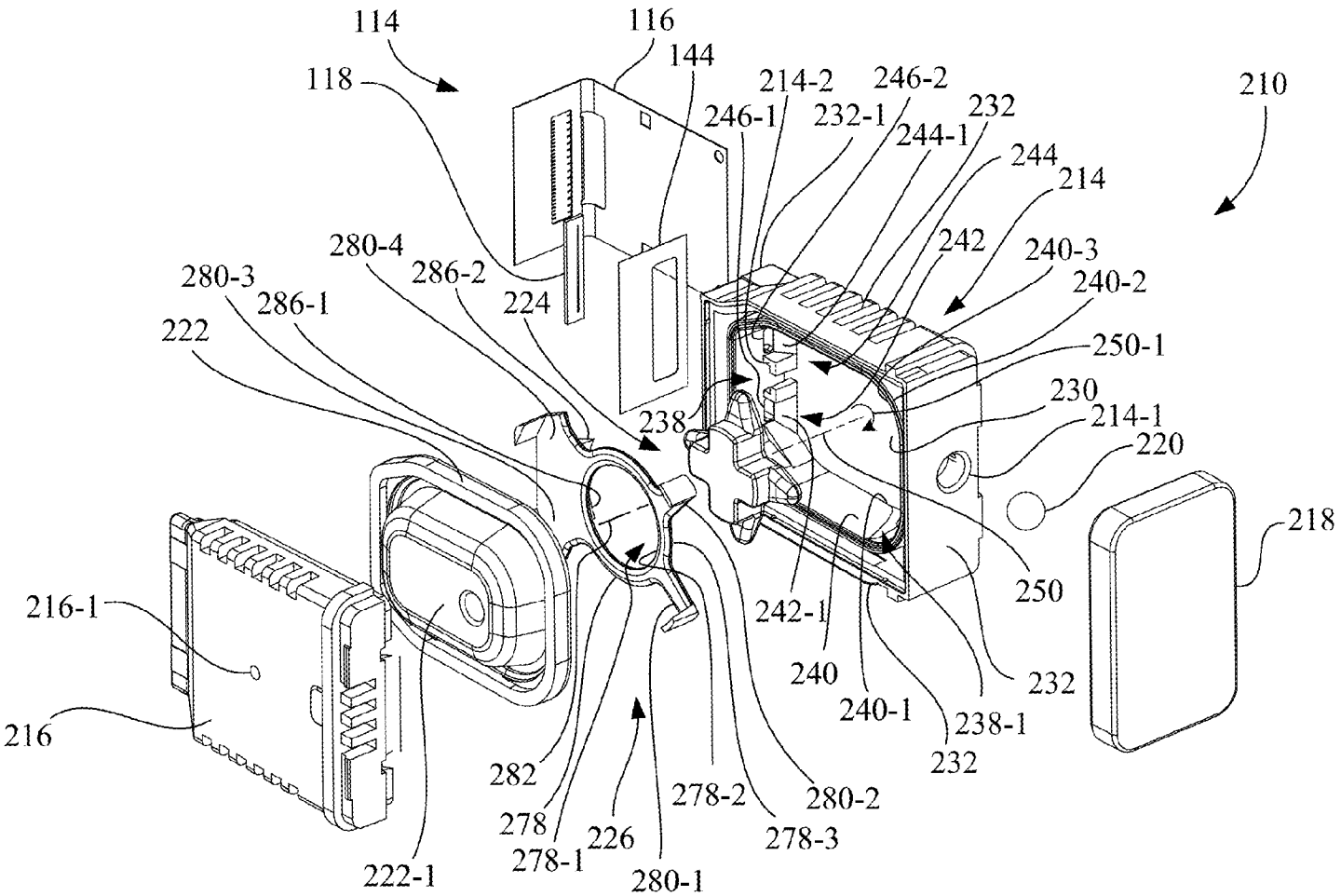
FIG. 19 is an exploded perspective view of the microfluidic dispensing device of FIG. 17, oriented for viewing into the chamber of the body in a direction toward the ejection chip.

As best shown in FIGS. 17-19, housing 212 includes a body 214, a lid 216, an end cap 218, and a fill plug 220 (e.g., ball). Contained within housing 212 is a diaphragm 222, a stir bar 224, and a guide portion 226. Each of housing 212 components, stir bar 224, and guide portion 226 may be made of plastic, using a molding process. Diaphragm 222 is made of rubber, using a molding process. Also, in the present embodiment, fill plug 220 may be in the form of a stainless steel ball bearing.

Referring to FIG. 18, in general, a fluid (not shown) is loaded through a fill hole 214-1 in body 214 (see FIG. 6) into a sealed region, i.e., a fluid reservoir 228, between body 214 and diaphragm 222. Back pressure in fluid reservoir 228 is set and then maintained by inserting, e.g., pressing, fill plug 220 into fill hole 214-1 to prevent air from leaking into fluid reservoir 228 or fluid from leaking out of fluid reservoir 228. End cap 218 is then placed onto an end of the body 214/lid 216 combination, opposite to ejection chip 118. Stir bar 224 resides in the sealed fluid reservoir 228 between body 214 and diaphragm 222 that contains the fluid. An internal fluid flow may be generated within fluid reservoir 228 by rotating stir bar 224 so as to provide fluid mixing and redistribution of particulate within the sealed region of fluid reservoir 228.

Figure 20:
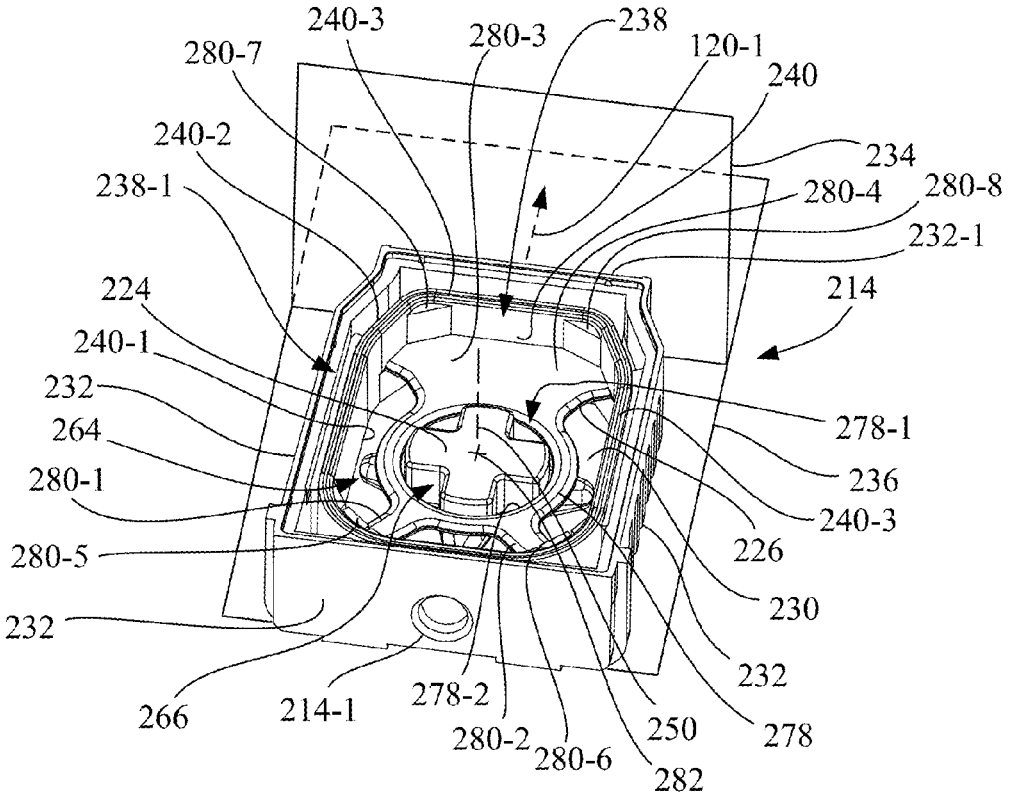
FIG. 20 is another perspective view of the microfluidic dispensing device of FIG. 17, with the end cap, lid and diaphragm removed to expose the guide portion and stir bar contained in the body, shown in relation to first and second planes and the fluid ejection direction.
Figure 21:
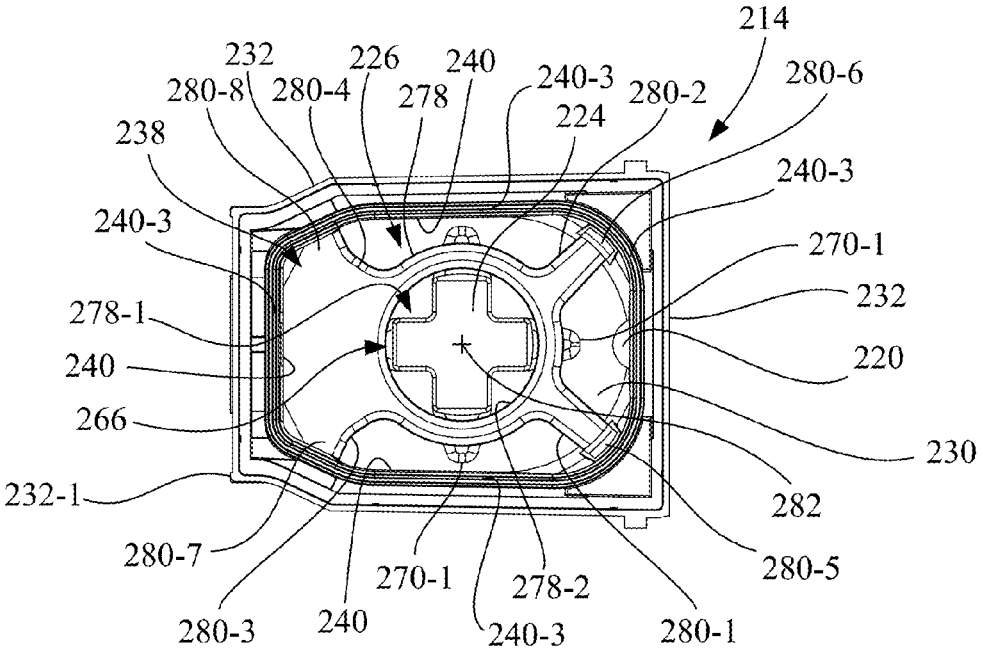
FIG. 21 is an orthogonal top view corresponding to the perspective view of FIG. 20, showing the body having a chamber that contains the guide portion and the stir bar.

Referring now also to FIGS. 20 and 21, body 214 of housing 212 has a base wall 230 and an exterior perimeter wall 232 contiguous with base wall 230. Exterior perimeter wall 232 is oriented to extend from base wall 230 in a direction that is substantially orthogonal to base wall 230. Referring to FIG. 19, lid 216 is configured to engage exterior perimeter wall 232. Thus, exterior perimeter wall 232 is interposed between base wall 230 and lid 216, with lid 216 being attached to the open free end of exterior perimeter wall 232 by weld, adhesive, or other fastening mechanism, such as a snap fit or threaded union.

Figure 23:
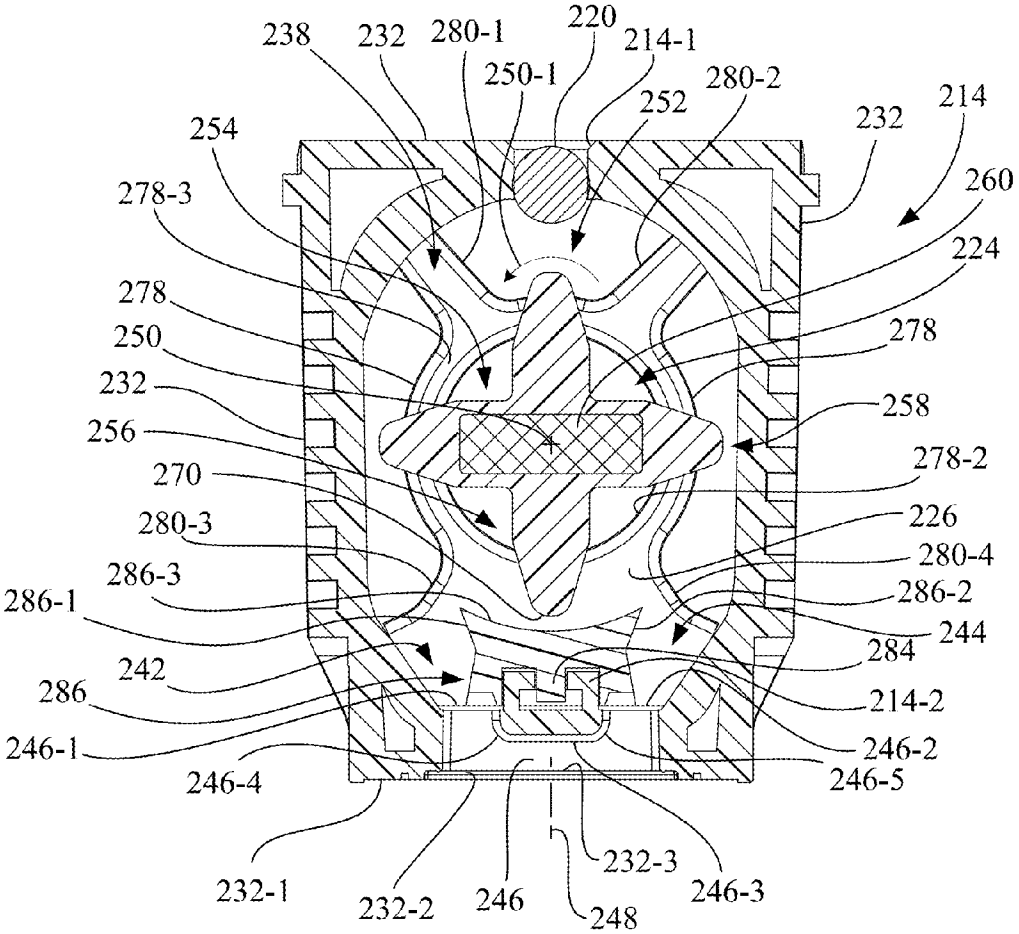
FIG. 23 is a section view taken along line 23-23 of FIG. 22.
Figure 22:
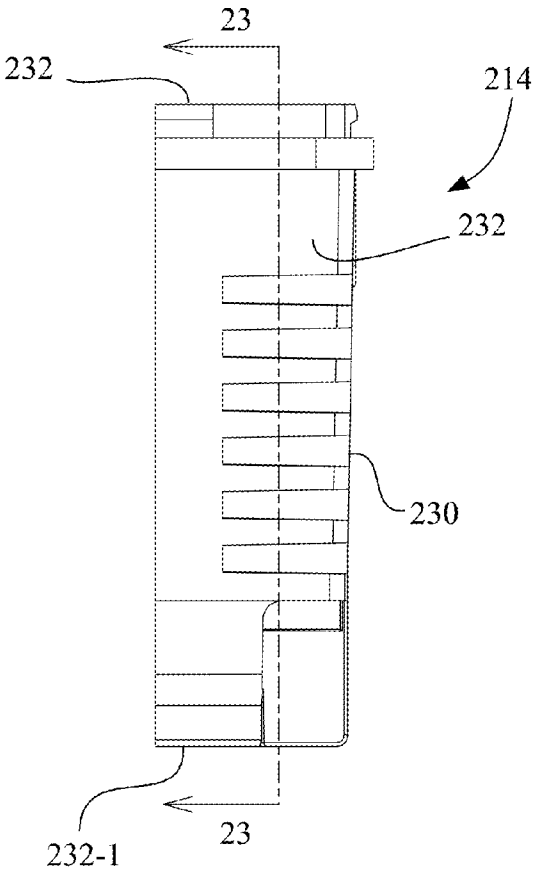
FIG. 22 is a side orthogonal view of the body of the microfluidic dispensing device of FIG. 17, wherein the body contains the guide portion and the stir bar.
Figure 24:
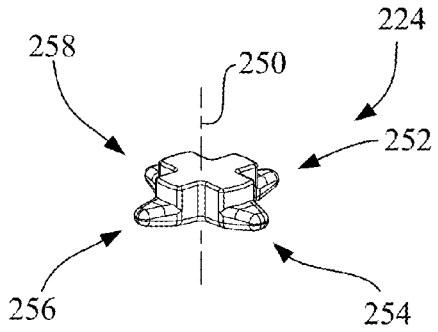
FIG. 24 is a perspective view of an embodiment of the stir bar of the microfluidic dispensing device of FIG. 17, as further depicted in FIGS. 18-21 and 23.

Referring also to FIGS. 18, 22 and 23, exterior perimeter wall 232 of body 214 includes an exterior wall 232-1, which is a contiguous portion of exterior perimeter wall 232. Exterior wall 232-1 has a chip mounting surface 232-2 and a fluid opening 232-3 adjacent to chip mounting surface 232-2 that passes through the thickness of exterior wall 232-1.

Referring again also to FIG. 20, chip mounting surface 232-2 defines a plane 234. Ejection chip 118 is mounted to chip mounting surface 232-2 and is in fluid communication with fluid opening 232-3 of exterior wall 232-1. An adhesive sealing strip 144 holds ejection chip 118 and TAB circuit 114 in place while a dispensed adhesive under ejection chip 118, and the encapsulant to protect the electrical leads, is cured. After the cure cycle, the liquid seal between ejection chip 118 and chip mounting surface 232-2 of body 214 is the die bond adhesive.

The planar extent of ejection chip 118 is oriented along the plane 234, with the plurality of ejection nozzles 120 (see e.g., FIG. 1) oriented such that the fluid ejection direction 120-1 is substantially orthogonal to the plane 234. Base wall 230 is oriented along a plane 236 that is substantially orthogonal to the plane 234 of exterior wall 232-1, and is substantially parallel to the fluid ejection direction 120-1.

As best illustrated in FIG. 20, body 214 of housing 212 includes a chamber 238 located within a boundary defined by exterior perimeter wall 232. Chamber 238 forms a portion of fluid reservoir 228, and is configured to define an interior space, and in particular, includes base wall 230 and has an interior perimetrical wall 240 configured to have rounded corners, so as to promote fluid flow in chamber 238. Referring to FIG. 19, interior perimetrical wall 240 of chamber 238 has an extent bounded by a proximal end 240-1 and a distal end 240-2. Proximal end 240-1 is contiguous with, and preferably forms a transition radius with, base wall 230. Distal end 240-2 is configured to define a perimetrical end surface 240-3 at a lateral opening 238-1 of chamber 238. Perimetrical end surface 240-3 may include a plurality of ribs, or undulations, to provide an effective sealing surface for engagement with diaphragm 222. The extent of interior perimetrical wall 240 of chamber 238 is substantially orthogonal to base wall 230, and is substantially parallel to the corresponding extent of exterior perimeter wall 232.

As best shown in FIG. 19, chamber 238 has an inlet fluid port 242 and an outlet fluid port 244, each of which is formed in a portion of interior perimetrical wall 240. Inlet fluid port 242 is separated a distance from outlet fluid port 244 along the portion of interior perimetrical wall 240. The terms "inlet" and "outlet" are terms of convenience that are used in distinguishing between the multiple ports of the present embodiment, and are correlated with a particular rotational direction 250-1 of stir bar 224. However, it is to be understood that it is the rotational direction of stir bar 224 that dictates whether a particular port functions as an inlet port or an outlet port, and it is within the scope of this invention to reverse the rotational direction of stir bar 224, and thus reverse the roles of the respective ports within chamber 238.

As best shown in FIG. 23, body 214 of housing 212 includes a fluid channel 246 interposed between a portion of interior perimetrical wall 240 of chamber 238 and exterior wall 232-1 of exterior perimeter wall 232 that carries ejection chip 118. Fluid channel 246 is configured to minimize particulate settling in a region of fluid opening 232-3, and in turn, ejection chip 118.

In the present embodiment, fluid channel 246 is configured as a U-shaped elongated passage having a channel inlet 246-1 and a channel outlet 246-2. Fluid channel 246 dimensions, e.g., height and width, and shape are selected to provide a desired combination of fluid flow and fluid velocity for facilitating intra-channel stirring.

Fluid channel 246 is configured to connect inlet fluid port 242 of chamber 238 in fluid communication with outlet fluid port 244 of chamber 238, and also connects fluid opening 232-3 of exterior wall 232-1 of exterior perimeter wall 232 in fluid communication with both inlet fluid port 242 and outlet fluid port 244 of chamber 238. In particular, channel inlet 246-1 of fluid channel 246 is located adjacent to inlet fluid port 242 of chamber 238 and channel outlet 246-2 of fluid channel 246 is located adjacent to outlet fluid port 244 of chamber 238. In the present embodiment, the structure of inlet fluid port 242 and outlet fluid port 244 of chamber 238 is symmetrical.

Fluid channel 246 has a convexly arcuate wall 246-3 that is positioned between channel inlet 246-1 and channel outlet 246-2, with fluid channel 246 being symmetrical about a channel mid-point 248. In turn, convexly arcuate wall 246-3 of fluid channel 246 is positioned between inlet fluid port 242 and outlet fluid port 244 of chamber 238 on the opposite side of interior perimetrical wall 240 from the interior space of chamber 238, with convexly arcuate wall 246-3 positioned to face fluid opening 232-3 of exterior wall 232-1 and fluid ejection chip 118.

Convexly arcuate wall 246-3 is configured to create a fluid flow substantially parallel to ejection chip 118. In the present embodiment, a longitudinal extent of convexly arcuate wall 246-3 has a radius that faces fluid opening 232-3, is substantially parallel to ejection chip 118, and has transition radii 246-4, 246-5 located adjacent to channel inlet 246-1 and channel outlet 246-2 surfaces, respectively. The radius and radii of convexly arcuate wall 246-3 help with fluid flow efficiency. A distance between convexly arcuate wall 246-3 and fluid ejection chip 118 is narrowest at the channel mid-point 248, which coincides with a mid-point of the longitudinal extent of fluid ejection chip 118, and in turn, with at a mid-point of the longitudinal extent of fluid opening 232-3 of exterior wall 232-1.

Referring again also to FIG. 19, each of inlet fluid port 242 and outlet fluid port 244 of chamber 238 has a beveled ramp structure configured such that each of inlet fluid port 242 and outlet fluid port 244 converges in a respective direction toward fluid channel 246. In particular, inlet fluid port 242 of chamber 238 has a beveled inlet ramp 242-1 configured such that inlet fluid port 242 converges, i.e., narrows, in a direction toward channel inlet 246-1 of fluid channel 246, and outlet fluid port 244 of chamber 238 has a beveled outlet ramp 244-1 that diverges, i.e., widens, in a direction away from channel outlet 246-2 of fluid channel 246.

Referring again to FIG. 18, diaphragm 222 is positioned between lid 216 and perimetrical end surface 240-3 of interior perimetrical wall 240 of chamber 238. The attachment of lid 216 to body 214 compresses a perimeter of diaphragm 222 thereby creating a continuous seal between diaphragm 222 and body 122, and more particularly, diaphragm 222 is configured for sealing engagement with perimetrical end surface 240-3 of interior perimetrical wall 240 of chamber 238 in forming fluid reservoir 228. Thus, in combination, chamber 148 and diaphragm 222 cooperate to define fluid reservoir 228 having a variable volume.

Referring particularly to FIGS. 18 and 19, an exterior surface of diaphragm 222 is vented to the atmosphere through a vent hole 216-1 located in lid 216 so that a controlled negative pressure can be maintained in fluid reservoir 228. Diaphragm 222 is made of rubber, and includes a dome portion 222-1 configured to progressively collapse toward base wall 230 as fluid is depleted from microfluidic dispensing device 210, so as to maintain a desired negative pressure in chamber 238, and thus changing the effective volume of the variable volume of fluid reservoir 228.

Referring to FIG. 18, for sake of further explanation, below, the variable volume of fluid reservoir 228, also referred to herein as a bulk region, may be considered to have a proximal continuous ⅓ volume portion 228-1, a central continuous ⅓ volume portion 228-2, and a distal continuous ⅓ volume portion 228-3, with the central continuous ⅓ volume portion 228-2 separating the proximal continuous ⅓ volume portion 228-1 from the distal continuous ⅓ volume portion 228-3. The proximal continuous ⅓ volume portion 228-1 is located closer to ejection chip 118 than either of the central continuous ⅓ volume portion 228-2 and the distal continuous ⅓ volume portion 228-3.

Referring to FIGS. 18 and 19, stir bar 224 resides in the variable volume of fluid reservoir 228 and in chamber 238, and is located within a boundary defined by interior perimetrical wall 240 of chamber 238. Referring also to FIGS. 24-27, stir bar 224 has a rotational axis 250 and a plurality of paddles 252, 254, 256, 258 that radially extend away from the rotational axis 250. Stir bar 224 has a magnet 260 (see FIGS. 18, 23, and 27), e.g., a permanent magnet, configured for interaction with external magnetic field generator 164 (see FIG. 1) to drive stir bar 224 to rotate around the rotational axis 250. In the present embodiment, stir bar 224 has two pairs of diametrically opposed paddles that are equally spaced at 90 degree increments around rotational axis 250. However, the actual number of paddles of stir bar 224 is two or more, and preferably three or four, but more preferably four, with each adjacent pair of paddles having the same angular spacing around the rotational axis 250. For example, a stir bar 224 configuration having three paddles would have a paddle spacing of 120 degrees, having four paddles would have a paddle spacing of 90 degrees, etc.

Figure 25:
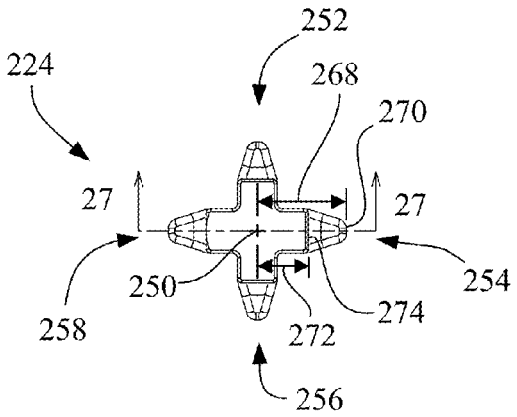
FIG. 25 is a top view of the stir bar of FIG. 24.
Figure 26:
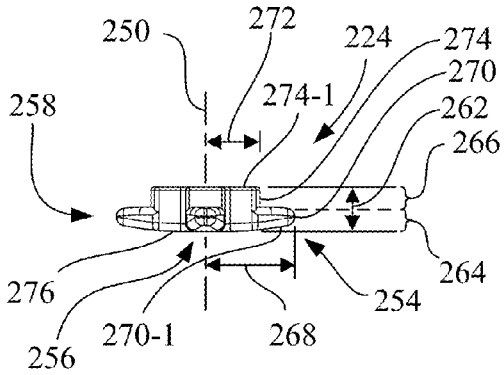
FIG. 26 is a side view of the stir bar of FIG. 24.
Figure 27:
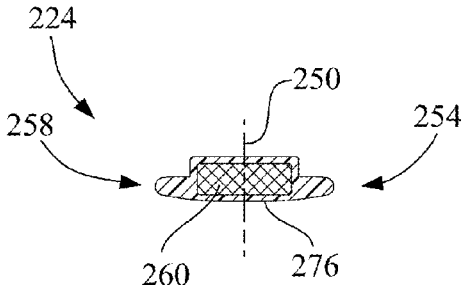
FIG. 27 is a section view of the stir bar taken along line 27-27 of FIG. 25.
Figure 28:
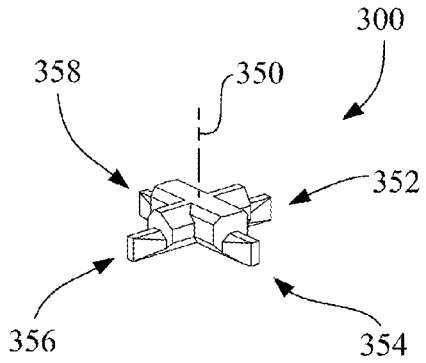
FIG. 28 is a perspective view of another embodiment of a stir bar suitable for use in the microfluidic dispensing device of FIG. 17.
Figure 29:
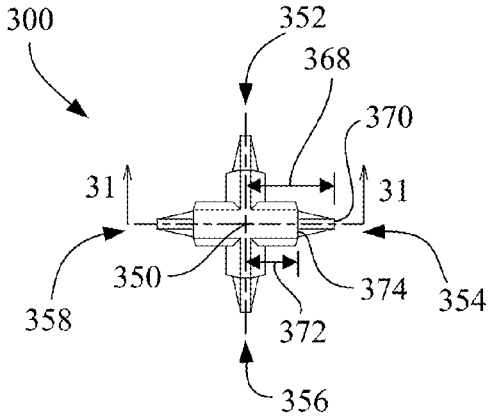
FIG. 29 is a top view of the stir bar of FIG. 28.
Figure 30:
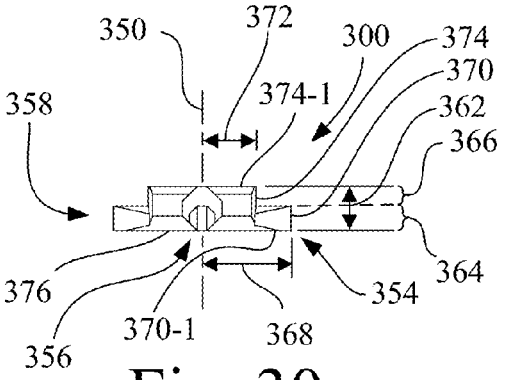
FIG. 30 is a side view of the stir bar of FIG. 28.
Figure 31:
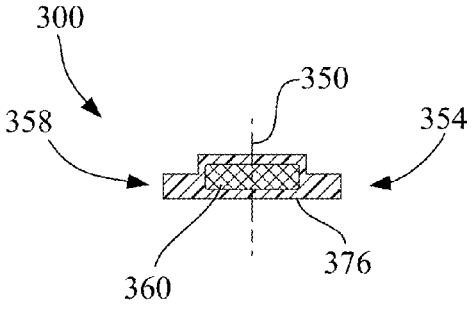
FIG. 31 is a section view of the stir bar taken along line 31-31 of FIG. 29.
Figure 32:
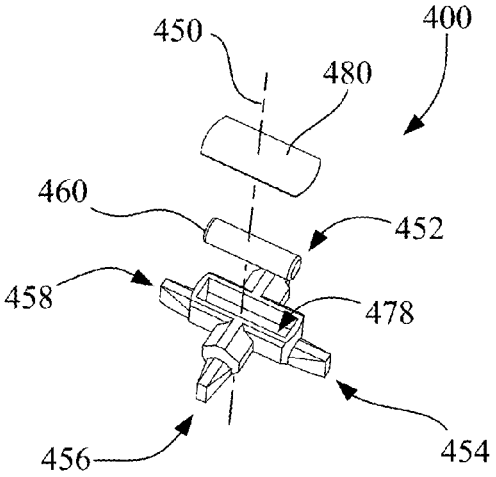
FIG. 32 is an exploded perspective view of another embodiment of a stir bar suitable for use in the microfluidic dispensing device of FIG. 17.
Figure 33:
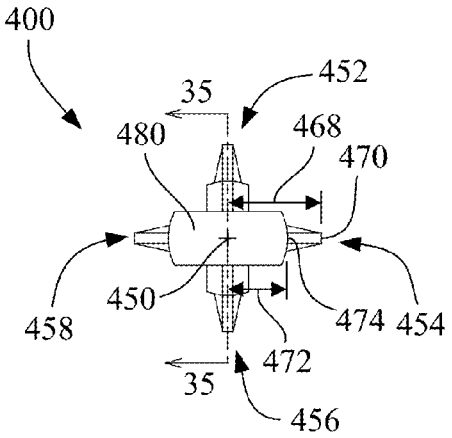
FIG. 33 is a top view of the stir bar of FIG. 32.
Figure 34:
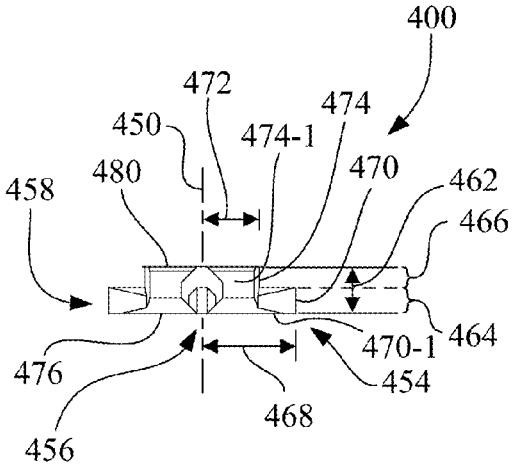
FIG. 34 is a side view of the stir bar of FIG. 32.
Figure 35:
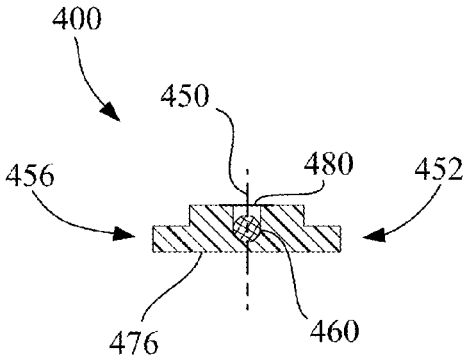
FIG. 35 is a section view of the stir bar taken along line 35-35 of FIG. 33.
Figure 36:
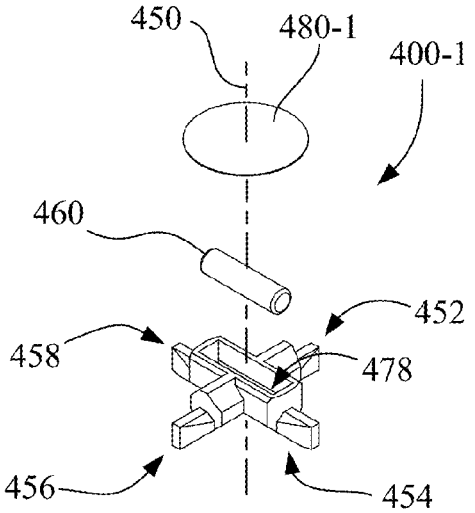
FIG. 36 is an exploded perspective view of another embodiment of a stir bar suitable for use in the microfluidic dispensing device of FIG. 17.
Figure 37:
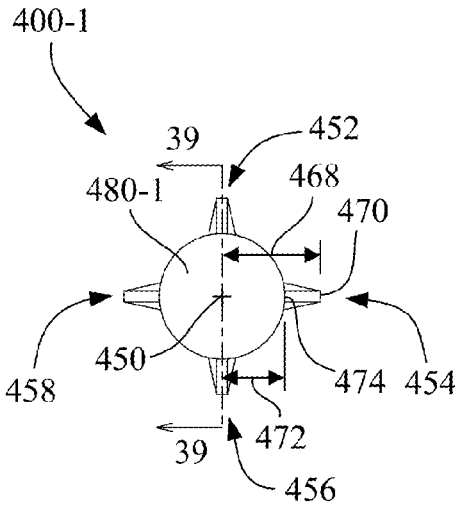
FIG. 37 is a top view of the stir bar of FIG. 36.
Figure 38:
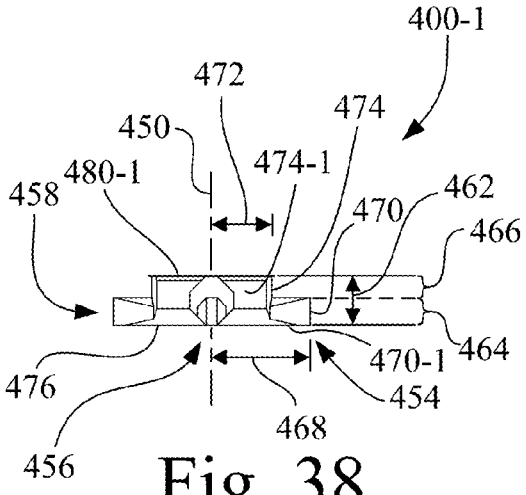
FIG. 38 is a side view of the stir bar of FIG. 36.
Figure 39:
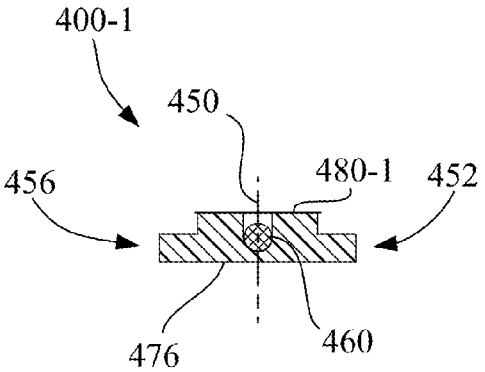
FIG. 39 is a section view of the stir bar taken along line 39-39 of FIG. 37.
Figure 40:
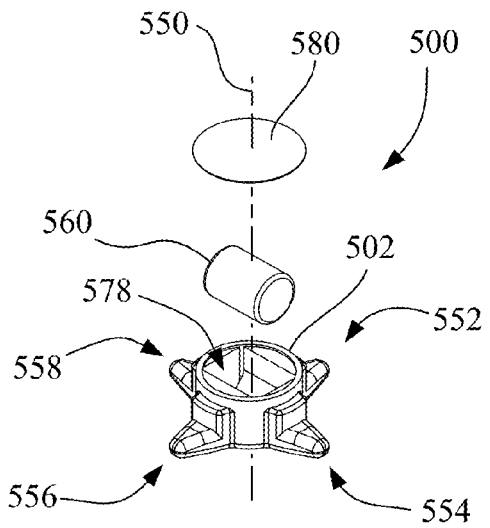
FIG. 40 is an exploded perspective view of another embodiment of a stir bar suitable for use in the microfluidic dispensing device of FIG. 17.
Figure 41:
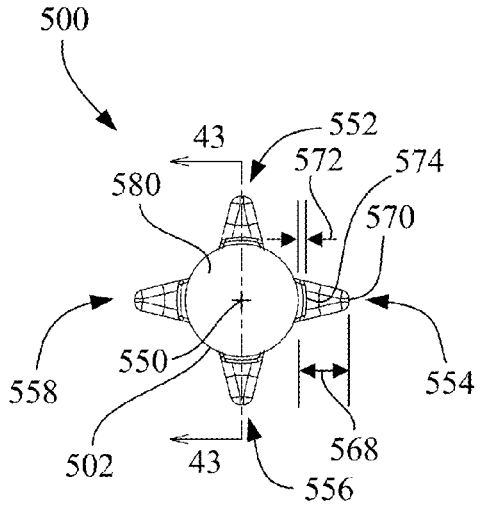
FIG. 41 is a top view of the stir bar of FIG. 40.
Figure 42:
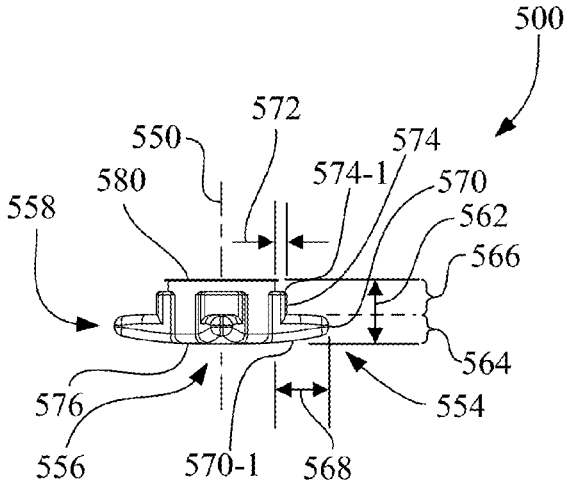
FIG. 42 is a side view of the stir bar of FIG. 40.
Figure 43:
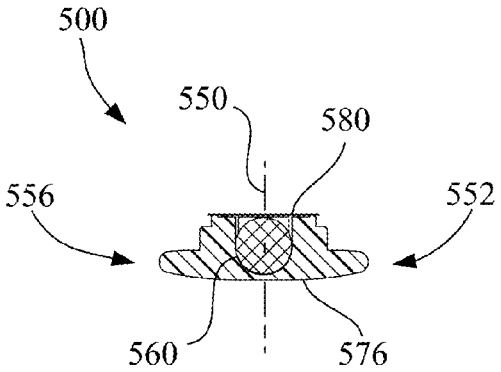
FIG. 43 is a section view of the stir bar taken along line 43-43 of FIG. 41.

In the present embodiment, as shown in FIGS. 24-27, stir bar 224 is configured in a stepped, i.e., two-tiered, cross pattern with chamfered surfaces which may provide the following desired attributes: quiet, short, low axial drag, good rotational speed transfer, and capable of starting to mix with stir bar 224 in particulate sediment. In particular, referring to FIG. 26, each of the plurality of paddles 252, 254, 256, 258 of stir bar 224 has an axial extent 262 having a first tier portion 264 and a second tier portion 266. Referring also to FIG. 25, first tier portion 264 has a first radial extent 268 terminating at a first distal end tip 270. Second tier portion 266 has a second radial extent 272 terminating in a second distal end tip 274. The first radial extent 268 is greater than the second radial extent 272, such that a first rotational velocity of first distal end tip 270 of first tier portion 264 is higher than a second rotational velocity of second distal end tip 274 of second tier portion 266.

Also, in the present embodiment, the first radial extent 268 is not limited by a cage containment structure, as in the previous embodiment, such that first distal end tip 270 advantageously may be positioned closer to the surrounding portions of interior perimetrical wall 240 of chamber 238, particularly in the central continuous ⅓ volume portion 228-2 and the distal continuous ⅓ volume portion 228-3. By reducing the clearance between first distal end tip 270 and interior perimetrical wall 240 of chamber 238, mixing effectiveness is improved. Stir bar 224 has a stir bar radius (first radial extent 268) from rotational axis 250 to the distal end tip 270 of first tier portion 264 of a respective paddle. A ratio of the stir bar radius and a clearance distance between the distal end tip 270 and its closest encounters with interior perimetrical wall 240 may be 5:2 to 5:0.025. In the present example, such clearance at each of the closest encounters may be in a range of 2.0 millimeters to 0.1 millimeters, and more preferably, is in a range of 1.0 millimeters to 0.1 millimeters.

First tier portion 264 has a first tip portion 270-1 that includes first distal end tip 270. First tip portion 270-1 may be tapered in a direction from the rotational axis 250 toward first distal end tip 270. First tip portion of 270-1 of first tier portion 264 has symmetrical upper and lower surfaces, each having a beveled, i.e., chamfered, leading surface and a beveled trailing surface. The beveled leading surfaces and the beveled trailing surfaces of first tip portion 270-1 are configured to converge at first distal end tip 270.

Also, in the present embodiment, first tier portion 264 of each of the plurality of paddles 252, 254, 256, 258 collectively form a convex surface 276. As shown in FIG. 18, convex surface 276 has a drag-reducing radius positioned to contact base wall 230 of chamber 238. The drag-reducing radius may be, for example, at least three times greater than the first radial extent 268 of first tier portion 264 of each of the plurality of paddles 252, 254, 256, 258.

Referring again to FIG. 26, second tier portion 266 has a second tip portion 274-1 that includes second distal end tip 274. Second distal end tip 274 may have a radial blunt end surface. Second tier portion 266 of each of the plurality of paddles 252, 254, 256, 258 has an upper surface having a beveled, i.e., chamfered, leading surface and a beveled trailing surface.

Referring to FIGS. 19-27, the rotational axis 250 of stir bar 224 may be oriented in an angular range of perpendicular, plus or minus 45 degrees, relative to the fluid ejection direction 120-1. Stated differently, the rotational axis 250 of stir bar 224 may be oriented in an angular range of parallel, plus or minus 45 degrees, relative to the planar extent (e.g., plane 234) of ejection chip 118. Also, rotational axis 250 of stir bar 224 may be oriented in an angular range of perpendicular, plus or minus 45 degrees, relative to the planar extent of base wall 230. In combination, the rotational axis 250 of stir bar 224 may be oriented in both an angular range of perpendicular, plus or minus 45 degrees, relative the fluid ejection direction 120-1 and/or the planar extent of base wall 230, and an angular range of parallel, plus or minus 45 degrees, relative to the planar extent of ejection chip 118.

More preferably, the rotational axis 250 has an orientation that is substantially perpendicular to the fluid ejection direction 120-1, an orientation that is substantially parallel to the plane 234, i.e., planar extent, of ejection chip 118, and an orientation that is substantially perpendicular to the plane 236 of base wall 230. In the present embodiment, the rotational axis 250 of stir bar 224 has an orientation that is substantially perpendicular to the plane 236 of base wall 230 in all orientations around rotational axis 250 and/or is substantially perpendicular to the fluid ejection direction 120-1 in all orientations around rotational axis 250.

The orientations of stir bar 224, described above, may be achieved by guide portion 226, with guide portion 226 also being located within chamber 238 in the variable volume of fluid reservoir 228, and more particularly, within the boundary defined by interior perimetrical wall 240 of chamber 238. Guide portion 226 is configured to confine and position stir bar 224 in a predetermined portion of the interior space of chamber 238 at one of the predefined orientations, described above.

Referring to FIGS. 18-21, for example, guide portion 226 may be configured to position the rotational axis 250 of stir bar 224 in an angular range of parallel, plus or minus 45 degrees, relative to the planar extent of ejection chip 118, and more preferably, guide portion 226 is configured to position the rotational axis 250 of stir bar 224 substantially parallel to the planar extent of ejection chip 118. In the present embodiment, guide portion 226 is configured to position and maintain an orientation of the rotational axis 250 of stir bar 224 to be substantially perpendicular to the plane 236 of base wall 230 in all orientations around rotational axis 250 and to be substantially parallel to the planar extent of ejection chip 118 in all orientations around rotational axis 250.

Referring to FIGS. 19-21 and 23, guide portion 226 includes an annular member 278, and a plurality of mounting arms 280-1, 280-2, 280-3, 280-4 coupled to annular member 278. Annular member 278 has an opening 278-1 that defines an annular confining surface 278-2. Opening 278-1 has a central axis 282. Second tier portion 266 of stir bar 224 is received in opening 278-1 of annular member 278. Annular confining surface 278-2 is configured to contact the radial extent of second tier portion 266 of the plurality of paddles 252, 254, 256, 258 to limit radial movement of stir bar 224 relative to the central axis 282. Referring to FIGS. 18-20 and 23, annular member 278 has an axial restraint surface 278-3 positioned to be axially offset from base wall 230 of chamber 238, for axial engagement with first tier portion 264 of stir bar 224.

Referring to FIGS. 20 and 21, the plurality of mounting arms 280-1, 280-2, 280-3, 280-4 are configured to engage housing 212 to suspend annular member 278 in the interior space of chamber 238, separated from base wall 230 of chamber 238, with axial restraint surface 278-3 positioned to face, and to be axially offset from, base wall 230 of chamber 238. A distal end of each of mounting arms 280-1, 280-2, 280-3, 280-4 includes respective locating features 280-5, 280-6, 280-7, 280-8 that have free ends to engage a perimetrical portion of diaphragm 222.

In the present embodiment, base wall 230 limits axial movement of stir bar 224 relative to the central axis 282 in a first axial direction and axial restraint surface 278-3 of annular member 278 is located to axially engage at least a portion of first tier portion 264 of the plurality of paddles 252, 254, 256, 258 to limit axial movement of stir bar 224 relative to the central axis 282 in a second axial direction opposite to the first axial direction.

As such, in the present embodiment, stir bar 224 is confined within the region defined by opening 278-1 and annular confining surface 278-2 of annular member 278, and between axial restraint surface 278-3 of annular member 278 and base wall 230 of chamber 238. The extent to which stir bar 224 is movable within fluid reservoir 228 is determined by the radial tolerances provided between annular confining surface 278-2 and stir bar 224 in the radial direction, and by the axial tolerances between stir bar 224 and the axial limit provided by the combination of base wall 230 and axial restraint surface 278-3 of annular member 278. For example, the tighter the radial and axial tolerances provided by guide portion 226, the less variation of the rotational axis 250 of stir bar 224 from perpendicular relative to base wall 230, and the less side-to-side motion of stir bar 224 within fluid reservoir 228.

In the present embodiment, guide portion 226 is configured as a unitary insert member that is removably attached to housing 212. Referring to FIG. 23, guide portion 226 includes a first retention feature 284 and body 214 of housing 212 includes a second retention feature 214-2. First retention feature 284 is engaged with second retention feature 214-2 to attach guide portion 226 to body 214 of housing 212 in a fixed relationship with housing 212. First retention feature 284/second retention feature 214-2 combination may be, for example, in the form of a tab/slot arrangement, or alternatively, a slot/tab arrangement, respectively.

As best shown in FIG. 23 with respect to FIG. 19, guide portion 226 may further include a flow control portion 286 having a flow separator feature 286-1, a flow rejoining feature 286-2, and a concavely arcuate surface 286-3. Flow control portion 286 provides an axial spacing between axial restraint surface 278-3 and base wall 230 in the region of inlet fluid port 242 and outlet fluid port 244. Concavely arcuate surface 286-3 is coextensive with, and extends between, each of flow separator feature 286-1 and flow rejoining feature 286-2. Flow separator feature 286-1 is positioned adjacent inlet fluid port 242 and flow rejoining feature 286-2 is positioned adjacent outlet fluid port 244. Flow separator feature 286-1 has a beveled wall that cooperates with beveled inlet ramp 242-1 (see FIG. 19) of inlet fluid port 242 of chamber 238 to guide fluid toward channel inlet 246-1 of fluid channel 246. Likewise, flow rejoining feature 286-2 has a beveled wall that cooperates with beveled outlet ramp 244-1 (see FIG. 19) of outlet fluid port 244 to guide fluid away from channel outlet 246-2 of fluid channel 246.

It is contemplated that all, or a portion, of flow control portion 286 may be incorporated into interior perimetrical wall 240 of chamber 238 of body 214 of housing 212.

In the present embodiment, as is best shown in FIG. 23, stir bar 224 is oriented such that the free ends of the plurality of paddles 252, 254, 256, 258 periodically face concavely arcuate surface 286-3 of flow control portion 286 as stir bar 224 is rotated about the rotational axis 250. A ratio of the stir bar radius and a clearance distance between the distal end tip 270 of first tier portion 264 of a respective paddle and flow control portion 286 may be 5:2 to 5:0.025. More particularly, guide portion 226 is configured to confine stir bar 224 in a predetermined portion of the interior space of chamber 238. In the present example, a distance between first distal end tip 270 and concavely arcuate surface 286-3 of flow control portion 286 is in a range of 2.0 millimeters to 0.1 millimeters, and more preferably, is in a range of 1.0 millimeters to 0.1 millimeters.

Also referring to FIG. 18, guide portion 226 is configured to position the rotational axis 250 of stir bar 224 in a portion of fluid reservoir 228 such that first distal end tip 270 of each of the plurality of paddles 252, 254, 256, 258 of stir bar 224 rotationally ingresses and egresses a proximal continuous ⅓ volume portion 228-1 of fluid reservoir 228 that is closer to ejection chip 118. Stated differently, guide portion 226 is configured to position the rotational axis 250 of stir bar 224 in a portion of the interior space such that first distal end tip 270 of each of the plurality of paddles 252, 254, 256, 258 rotationally ingresses and egresses the continuous ⅓ volume portion 228-1 of the interior space of chamber 238 that includes inlet fluid port 242 and outlet fluid port 244.

More particularly, in the present embodiment wherein stir bar 224 has four paddles, guide portion 226 is configured to position the rotational axis 250 of stir bar 224 in a portion of the interior space of chamber 238 such that first distal end tip 270 of each the two pairs of diametrically opposed paddles alternatingly and respectively are positioned in the proximal continuous ⅓ volume portion 228-1 of the volume of the interior space of chamber 238 that includes inlet fluid port 242 and outlet fluid port 244 and in the distal continuous ⅓ volume portion 228-3 of the interior space that is furthest from ejection chip 118. More particularly, in the present embodiment wherein stir bar 224 has two sets of diametrically opposed paddles, guide portion 226 is configured to position the rotational axis 250 of stir bar 224 in a portion of the interior space of chamber 238 such that first distal end tip 270 of each of diametrically opposed paddles, e.g., 252, 256 or 254, 258, as shown in FIG. 23, alternatingly and respectively are positioned in the proximal continuous ⅓ volume portion 228-1 and the distal continuous ⅓ volume portion 228-3 as stir bar 224 is rotated.

FIGS. 28-31 show a configuration for a stir bar 300, which may be substituted for stir bar 224 of microfluidic dispensing device 210 discussed above with respect to the embodiment of FIGS. 17-27 for use with guide portion 226.

Stir bar 300 has a rotational axis 350 and a plurality of paddles 352, 354, 356, 358 that radially extend away from the rotational axis 350. Stir bar 300 has a magnet 360 (see FIG. 31), e.g., a permanent magnet, configured for interaction with external magnetic field generator 164 (see FIG. 1) to drive stir bar 300 to rotate around the rotational axis 350. In the present embodiment, stir bar 300 has two pairs of diametrically opposed paddles that are equally spaced at 90 degree increments around rotational axis 350.

In the present embodiment, as shown, stir bar 300 is configured in a stepped, i.e., two-tiered, cross pattern with chamfered surfaces. In particular, each of the plurality of paddles 352, 354, 356, 358 of stir bar 300 has an axial extent 362 having a first tier portion 364 and a second tier portion 366. First tier portion 364 has a first radial extent 368 terminating at a first distal end tip 370. Second tier portion 366 has a second radial extent 372 terminating in a second distal end tip 374. The first radial extent 368 is greater than the second radial extent 372, such that a first rotational velocity of first distal end tip 370 of first tier portion 364 of stir bar 300 is higher than a second rotational velocity of second distal end tip 374 of second tier portion 366 of stir bar 300.

First tier portion 364 has a first tip portion 370-1 that includes first distal end tip 370. First tip portion 370-1 may be tapered in a direction from the rotational axis 350 toward first distal end tip 370. First tip portion 370-1 of first tier portion 364 has symmetrical upper and lower surfaces, each having a beveled, i.e., chamfered, leading surface and a beveled trailing surface. The beveled leading surfaces and the beveled trailing surfaces of first tip portion 370-1 are configured to converge at first distal end tip 370. Also, in the present embodiment, first tier portion 364 of each of the plurality of paddles 352, 354, 356, 358 collectively form a flat surface 376 for engaging base wall 230.

Second tier portion 366 has a second tip portion 374-1 that includes second distal end tip 374. Second distal end tip 374 may have a radially blunt end surface. Second tier portion 366 has two diametrical pairs of upper surfaces, each having a beveled, i.e., chamfered, leading surface and a beveled trailing surface. However, in the present embodiment, the two diametrical pairs have different configurations, in that the area of the upper beveled leading surface and upper beveled trailing surface for diametrical pair of paddles 352, 356 is greater than the area of bevel of the upper beveled leading surface and upper beveled trailing surface for diametrical pair of paddles 354, 358. As such, adjacent angularly spaced pairs of the plurality of paddles 352, 354, 356, 358 alternatingly provide less and more aggressive agitation, respectively, of the fluid in fluid reservoir 228.

FIGS. 32-35 show a configuration for a stir bar 400, which may be substituted for stir bar 224 of microfluidic dispensing device 210 discussed above with respect to the embodiment of FIGS. 17-27 for use with guide portion 226.

Stir bar 400 has a rotational axis 450 and a plurality of paddles 452, 454, 456, 458 that radially extend away from the rotational axis 450. Stir bar 400 has a magnet 460 (see FIGS. 32 and 35, e.g., a permanent magnet), configured for interaction with external magnetic field generator 164 (see FIG. 1) to drive stir bar 400 to rotate around the rotational axis 450. In the present embodiment, stir bar 400 has two pairs of diametrically opposed paddles that are equally spaced at 90 degree increments around rotational axis 450.

In the present embodiment, as shown, stir bar 400 is configured in a stepped, i.e., two-tiered, cross pattern. In particular, each of the plurality of paddles 452, 454, 456, 458 of stir bar 400 has an axial extent 462 having a first tier portion 464 and a second tier portion 466. First tier portion 464 has a first radial extent 468 terminating at a first distal end tip 470. Second tier portion 466 has a second radial extent 472 terminating in a second distal end tip 474 having a wide radial end shape. The first radial extent 468 is greater than the second radial extent 472, such that a first rotational velocity of first distal end tip 470 of first tier portion 464 of stir bar 400 is higher than a second rotational velocity of second distal end tip 474 of second tier portion 466 of stir bar 400.

First tier portion 464 has a first tip portion 470-1 that includes first distal end tip 370. First tip portion 470-1 may be tapered in a direction from the rotational axis 450 toward first distal end tip 470. First tip portion 470-1 of first tier portion 464 has symmetrical upper and lower surfaces, each having a beveled, i.e., chamfered, leading surface and a beveled trailing surface. The beveled leading surfaces and the beveled trailing surfaces of first tip portion 470-1 are configured to converge at first distal end tip 470. Also, in the present embodiment, first tier portion 464 of each of the plurality of paddles 452, 454, 456, 458 collectively form a flat surface 476 for engaging base wall 230.

Second tier portion 466 has a second tip portion 474-1 that includes second distal end tip 474. Second tip portion 474-1 has a radially blunt end surface. Second tier portion 466 has two diametrical pairs of upper surfaces. However, in the present embodiment, the two diametrical pairs have different configurations, in that the diametrical pair of paddles 452, 456 have upper beveled leading surfaces and upper beveled trailing surfaces, and the diametrical pair of paddles 454, 458 do not, i.e., provide a blunt lateral surface substantially parallel to rotational axis 450.

Referring again to FIGS. 32 and 35, stir bar 400 includes a void 478 that radially intersects the rotational axis 450, with void 478 being located in the diametrical pair of paddles 454, 458. Magnet 460 is positioned in void 478 with the north pole of magnet 460 and the south pole of magnet 460 being diametrically opposed with respect to the rotational axis 450. A film seal 480 is attached, e.g., by ultrasonic welding, heat staking, laser welding, etc., to stir bar 400 to cover over void 478. It is preferred that film seal 480 have a seal layer material that is chemically compatible with the material of stir bar 400. Film seal 480 has a shape that conforms to the shape of the upper surface of second tier portion 466 of diametrical pair of paddles 454, 458. The present configuration has an advantage over a stir bar insert that is molded around the magnet, since insert molding may slightly demagnetize the magnet from the insert mold process heat.

FIGS. 36-39 show a configuration for a stir bar 400-1, having substantially the same configuration as stir bar 400 discussed above with respect to FIGS. 32-35, with the sole difference being the shape of the film seal used to seal void 478. Stir bar 400-1 has a film seal 480-1 having a circular shape, and which has a diameter that forms an arcuate web between adjacent pairs of the plurality of paddles 452, 454, 456, 458. The web features serve to separate the bulk mixing flow in the region between stir bar 400-1 and diaphragm 222, and the regions between adjacent pairs of the plurality of paddles 452, 454, 456, 458.

FIGS. 40-43 show a configuration for a stir bar 500, which may be substituted for stir bar 224 of microfluidic dispensing device 210 discussed above with respect to the embodiment of FIGS. 17-27 for use with guide portion 226.

Stir bar 500 has a cylindrical hub 502 having a rotational axis 550, and a plurality of paddles 552, 554, 556, 558 that radially extend away from cylindrical hub 502. Stir bar 500 has a magnet 560 (see FIGS. 40 and 43), e.g., a permanent magnet, configured for interaction with external magnetic field generator 164 (see FIG. 1) to drive stir bar 500 to rotate around the rotational axis 550.

In the present embodiment, as shown, the plurality of paddles 552, 554, 556, 558 of stir bar 500 are configured in a stepped, i.e., two-tiered, cross pattern with chamfered surfaces. In particular, each of the plurality of paddles 552, 554, 556, 558 of stir bar 500 has an axial extent 562 having a first tier portion 564 and a second tier portion 566. First tier portion 564 has a first radial extent 568 terminating at a first distal end tip 570. Second tier portion 566 has a second radial extent 572 terminating in a second distal end tip 574.

First tier portion 564 has a first tip portion 570-1 that includes first distal end tip 570. First tip portion 570-1 may be tapered in a direction from the rotational axis 550 toward first distal end tip 570. First tip portion 570-1 of first tier portion 564 has symmetrical upper and lower surfaces, each having a beveled, i.e., chamfered, leading surface and a beveled trailing surface. The beveled leading surfaces and the beveled trailing surfaces of first tip portion 570-1 are configured to converge at first distal end tip 570. First tier portion 564 of each of the plurality of paddles 552, 554, 556, 558, and cylindrical hub 502, collectively form a convexly curved surface 576 for engaging base wall 230.

The second tier portion 566 has a second tip portion 574-1 that includes second distal end tip 574. Second distal end tip 574 may have a radially blunt end surface. Second tier portion 566 has an upper surface having a chamfered leading surface and a chamfered trailing surface.

Referring again to FIGS. 40 and 43, stir bar 500 includes a void 578 that radially intersects the rotational axis 550, with void 578 being located in cylindrical hub 502. Magnet 560 is positioned in void 578 with the north pole of magnet 560 and the south pole of magnet 560 being diametrically opposed with respect to the rotational axis 550. A film seal 580 has a shape that conforms to the circular shape of the upper surface of cylindrical hub 502. Film seal 580 is attached, e.g., by ultrasonic welding, heat staking, laser welding, etc., to the upper surface of cylindrical hub 502 of stir bar 500 to cover over void 578. It is preferred that film seal 580 have a seal layer material that is chemically compatible with the material of stir bar 500.

Figure 44:
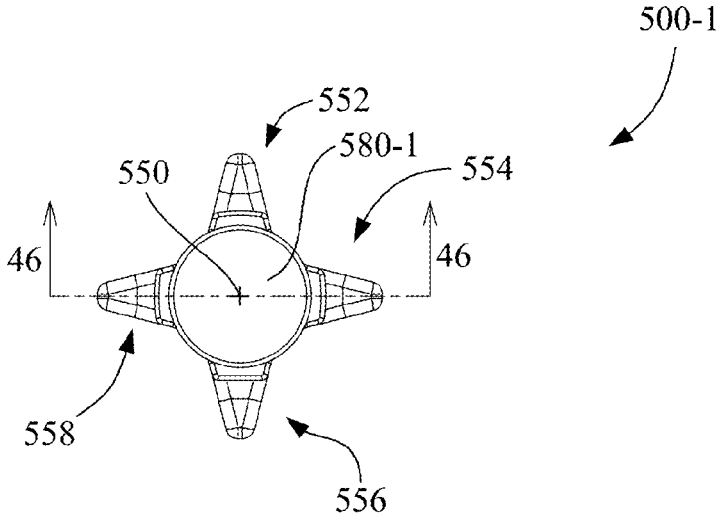
FIG. 44 is a top view of another embodiment of a stir bar suitable for use in the microfluidic dispensing device of FIG. 17.
Figure 45:
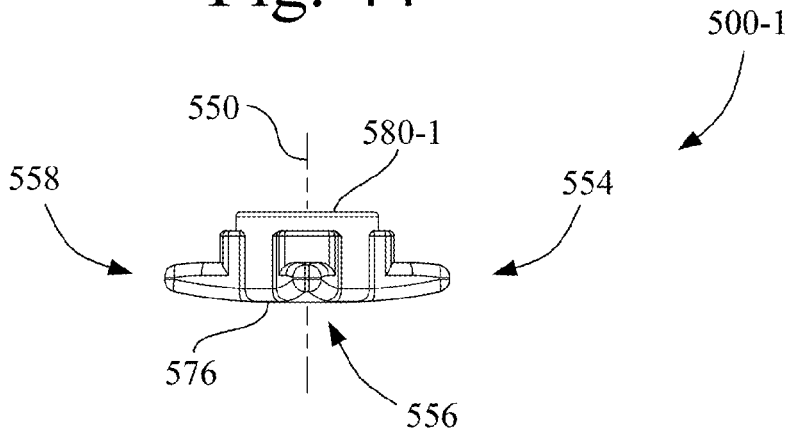
FIG. 45 is a side view of the stir bar of FIG. 45.
Figure 46:
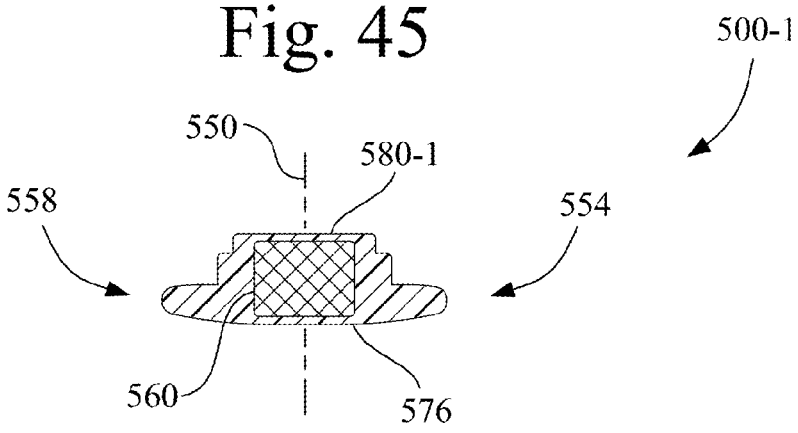
FIG. 46 is a section view of the stir bar taken along line 46-46 of FIG. 44.

FIGS. 44-46 show a configuration for a stir bar 500-1, having substantially the same configuration as stir bar 500 discussed above with respect to FIGS. 40-43, with the sole difference being that film seal 580 used to seal void 578 has been replaced with a permanent cover 580-1. In this embodiment, cover 580-1 is unitary with the stir bar body, which are formed around magnet 560 during the insert molding process.

While the stir bar embodiments of FIGS. 24-46 have been described as being for use with microfluidic dispensing device 210 having guide portion 226, those skilled in the art will recognize that stir bar 132 described above in relation to microfluidic dispensing device 110 having guide portion 134 may be modified to also include a two-tiered stir bar paddle design for use with guide portion 134.

Figure 47:
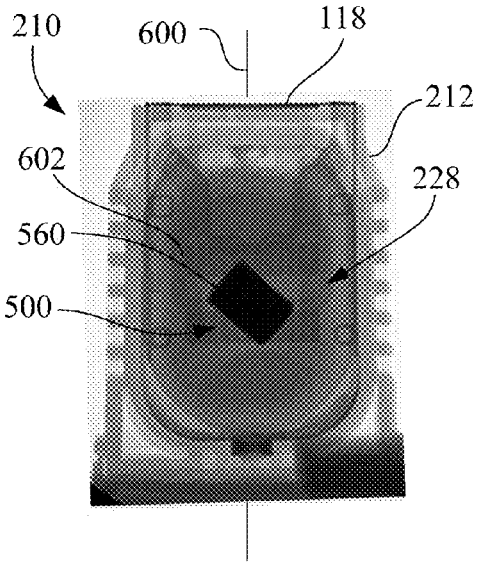
FIG. 47 is an x-ray image of a microfluidic dispensing device configured in accordance with FIGS. 17-23, which depicts an appropriate particulate suspension in the fluid, such as a newly filled microfluidic dispensing device, or after implementation of a method of the present invention to re-mix the fluid in the fluid reservoir.

When fluid is first introduced into the respective microfluidic dispensing device, e.g., microfluidic dispensing device 210, the fluid is at a desired state of particulate suspension having a mixed viscosity. This ideal condition is illustrated in FIG. 47. In particular, FIG. 47 is an x-ray image of an implementation of microfluidic dispensing device 210 of FIGS. 17-23 having a longitudinal extent of housing 212 arranged along a vertical axis 600. FIG. 47 illustrates fluid 602 having suspended particulate content, and with no accumulation of settled particulate, i.e., in an ideal state for use.

However, over time, the particulate portion of the fluid tends to separate from the bulk liquid portion of the fluid. In turn, over time, the particulate portion tends to accumulate as a settled particulate portion formed as a settled layer of particles. In order to achieve coverage uniformity of the ejected fluid, it is desirable to maintain the fluid at the desired state of particulate suspension in the fluid liquid by performing fluid re-mixing operations.

It has been observed that the density of the bulk fluid liquid portion of the fluid is less than the density of the settled particulate portion. Also, the dense settled layer of the settled particulate portion will have a greater viscosity than the viscosity of the desired mixed fluid. The separated fluid may also create re-mixing challenges because the higher density of the settled particulate portion will tend to inhibit the rotational motion of the stir bar.

Figure 48:
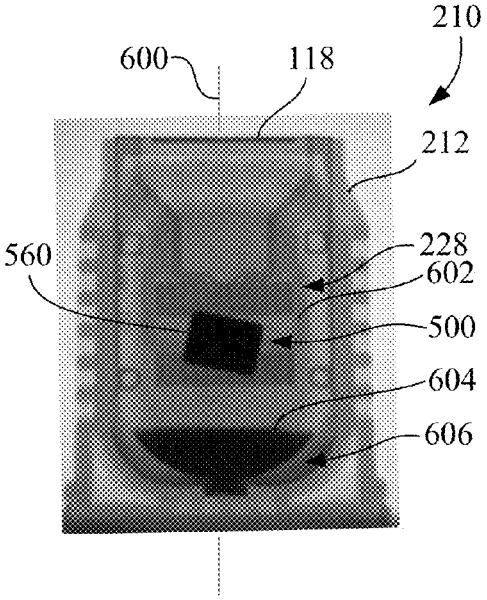
FIG. 48 is an x-ray image of a microfluidic dispensing device configured in accordance with FIGS. 17-23 having a longitudinal extent of the housing arranged along a vertical axis, and showing an accumulation of settled particulate at a gravitational low region of the fluid reservoir.

FIG. 48 is an x-ray image of an implementation of microfluidic dispensing device 210 having the longitudinal extent of housing 212 arranged along a vertical axis 600, with housing 212 oriented such that ejection chip 118 faces vertically upward and with the planar extent of ejection chip 118 being substantially perpendicular to vertical axis 600. Contained in housing 212 is stir bar 500 having magnet 560. Fluid reservoir 228 of microfluidic dispensing device 210 is shown to contain fluid 602 that includes settled particulate 604 at a gravitational low region 606 of fluid reservoir 228. In the orientation shown, ejection chip 118 is facing vertically upward, and the settled particulate 604 has accumulated at the gravitational low region 606 of fluid reservoir 228 on the opposite end of housing 212 relative to ejection chip 118.

Figure 49:
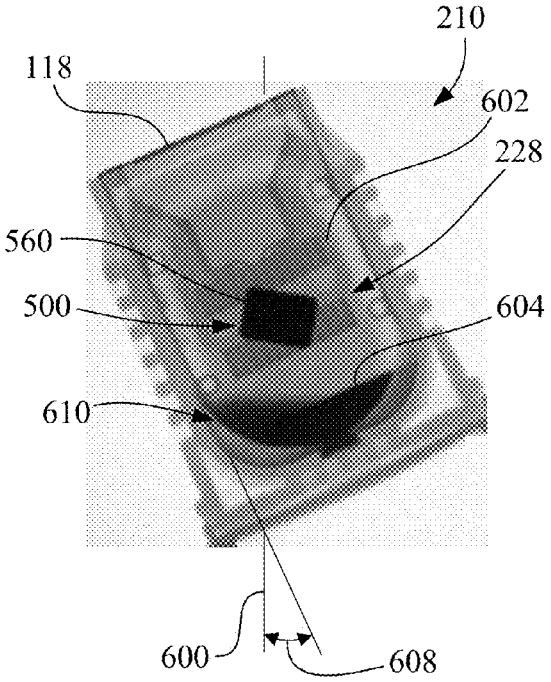
FIG. 49 is an x-ray image of the microfluidic dispensing device of FIG. 48, which is tilted off-axis from the vertical axis to depict how settled particulate migrates to a new gravitational low region of the fluid reservoir based on the change of orientation.

FIG. 49 is an x-ray image of an implementation of microfluidic dispensing device 210 tilted off-axis from vertical axis 600 by an angular amount 608 of about 20 to 25 degrees, and depicts how settled particulate 604 migrates to a new gravitational low region 610 of fluid reservoir 228 based on the change of orientation of housing 212 relative to vertical axis 600. Also, it can be seen that the particulate layer adjacent to the walls of fluid reservoir 228 do not tend to move easily by changing the orientation of microfluidic dispensing device 210.

Figure 50:
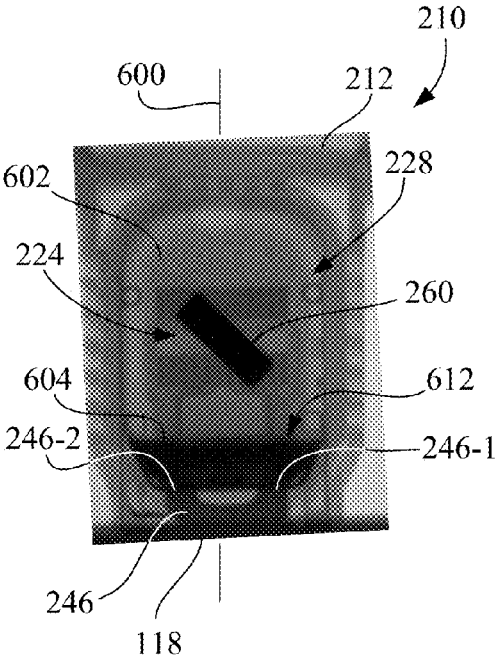
FIG. 50 is an x-ray image of a microfluidic dispensing device configured in accordance with FIGS. 17-23, wherein the ejection chip faces vertically downward and settled particulate has accumulated over the channel inlet and the channel outlet of the fluid channel that feeds fluid to the ejection chip.

FIG. 50 is an x-ray image of an implementation of microfluidic dispensing device 210 (containing stir bar 224 having magnet 260; see also FIGS. 18 and 23) that illustrates an undesirable orientation, wherein housing 212 is oriented such that ejection chip 118 faces vertically downward with the planar extent of ejection chip 118 being substantially perpendicular to vertical axis 600. As shown, settled particulate 604 migrates to a new gravitational low region 612 of fluid reservoir 228 based on the change of orientation of housing 212, such that settled particulate 604 has accumulated over channel inlet 246-1 and channel outlet 246-2 of fluid channel 246. Thus, without sufficient mixing of fluid 602, settled particulate 604 would render microfluidic dispensing device 210 inoperable, by completely blocking fluid channel 246, which in turn, would prevent fluid from reaching ejection chip 118.

Figure 51:
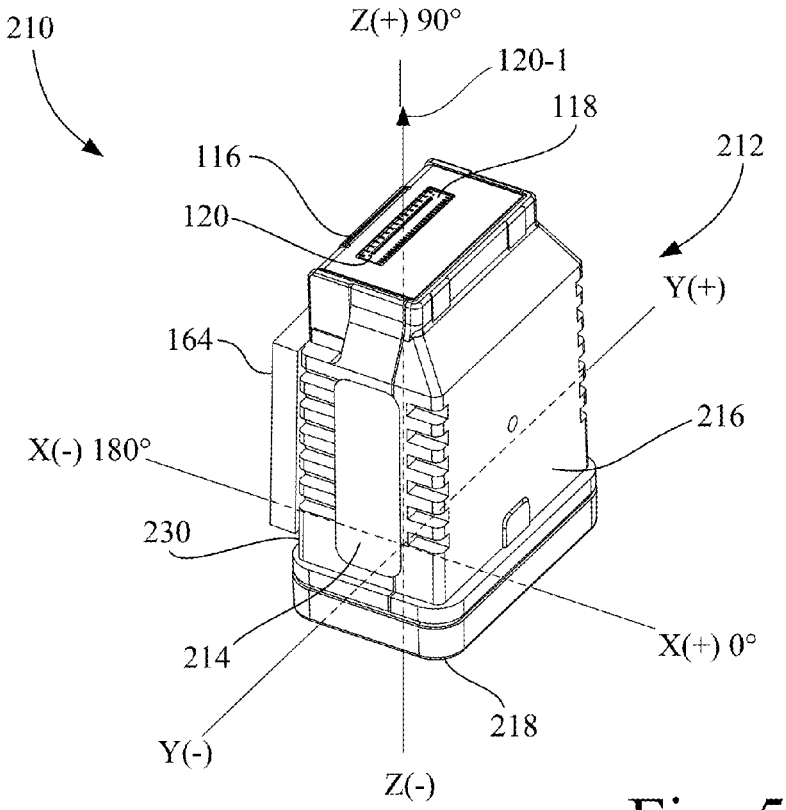
FIG. 51 is a perspective view of the microfluidic dispensing device of FIGS. 17-23, shown in a Cartesian space having X, Y, and Z axes, with the longitudinal extent of the housing on the positive Z-axis and the lateral extent of the housing lying on the X-Y plane.

Referring to FIG. 51, microfluidic dispensing device 210 is shown in a Cartesian space having X, Y, and Z axes, with the longitudinal extent of housing 212 lying on the positive Z-axis and the lateral extent of housing 212 lying on the X-Y-plane. In the X-Z plane, the positive X-axis represents 0 degrees; the Z-axis represents vertical, with the upper Z-axis (positive) labeled as 90 degrees, corresponding to vertical axis 600 discussed above; and the X-axis (negative) represents 180 degrees. An orientation of the longitudinal extent of housing 212 of microfluidic dispensing device 210 is represented by fluid ejection direction 120-1, and which also represents the direction that ejection chip 118 and fluid channel 246 is facing.

In preparation for mixing, microfluidic dispensing device 210 may be positioned such that fluid ejection direction 120-1 does not face downward. The term "not face downward" means that the arrow of fluid ejection direction 120-1 does not point below the X-Y plane, i.e., is never less than horizontal. Thus, in the orientation of the present example, microfluidic dispensing device 210 may be rotated in the X-Z plane about the Y-axis, in a range of upward vertical (Z+ at 90 degrees) plus or minus 90 degrees, i.e., upward vertical to horizontal without the fluid ejection direction 120-1 being pointed downward.

It is noted that the planar extent of ejection chip 118 is substantially perpendicular to fluid ejection direction 120-1 in all orientations around fluid ejection direction 120-1, and the planar extent of base wall 230 of housing 212 of microfluidic dispensing device 210 is substantially parallel to fluid ejection direction 120-1. Thus, the direction of tilt of housing 212 (X+ or X−) in the X-Z plane (e.g., base wall 230 facing upwardly or facing downwardly) may determine the extent to which particulate settlement may accumulate around stir bar 224.

Figure 52:
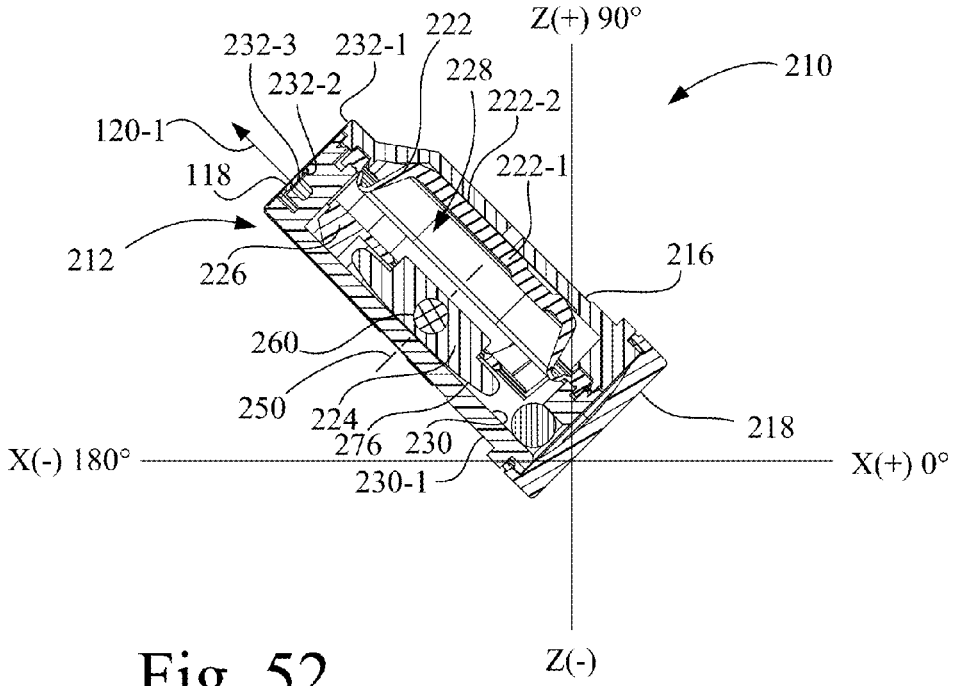
FIG. 52 shows the microfluidic dispensing device depicted in FIG. 18 at an orientation wherein the fluid ejection direction is pointing upwardly at 135 degrees, and with an exterior of the dome portion of the diaphragm facing upwardly and with an exterior of the base wall facing downwardly.

In the illustration of FIG. 52, microfluidic dispensing device 210 is shown with fluid ejection direction 120-1 pointing upwardly at 135 degrees (i.e., positive 45 degrees offset from 90 degrees (upward vertical)), and with microfluidic dispensing device 210 oriented with an exterior 222-2 of dome portion 222-1 of diaphragm 222 facing upwardly and with an exterior 230-1 of base wall 230 facing downwardly. The angle at which each of the exterior 222-2 of diaphragm 222 and the exterior 230-1 of base wall 230 is considered to face corresponds to the angle at which rotational axis 250 of stir bar 224 intersects the upward vertical portion of the Z-axis, with the exception of when rotational axis 250 of stir bar 224 is parallel to the Z-axis. In the example of FIG. 52, the exterior 222-2 of dome portion 222-1 of diaphragm 222 is facing upwardly at 45 degrees and the exterior 230-1 of base wall 230 is facing downwardly at 45 degrees. At the 135 degree orientation of fluid ejection direction 120-1 depicted in FIG. 52, any particulate settled or settling along base wall 230 will start to migrate toward a gravitational low point in fluid reservoir 228 and away from stir bar 224 (see also FIG. 49).

Figure 53:
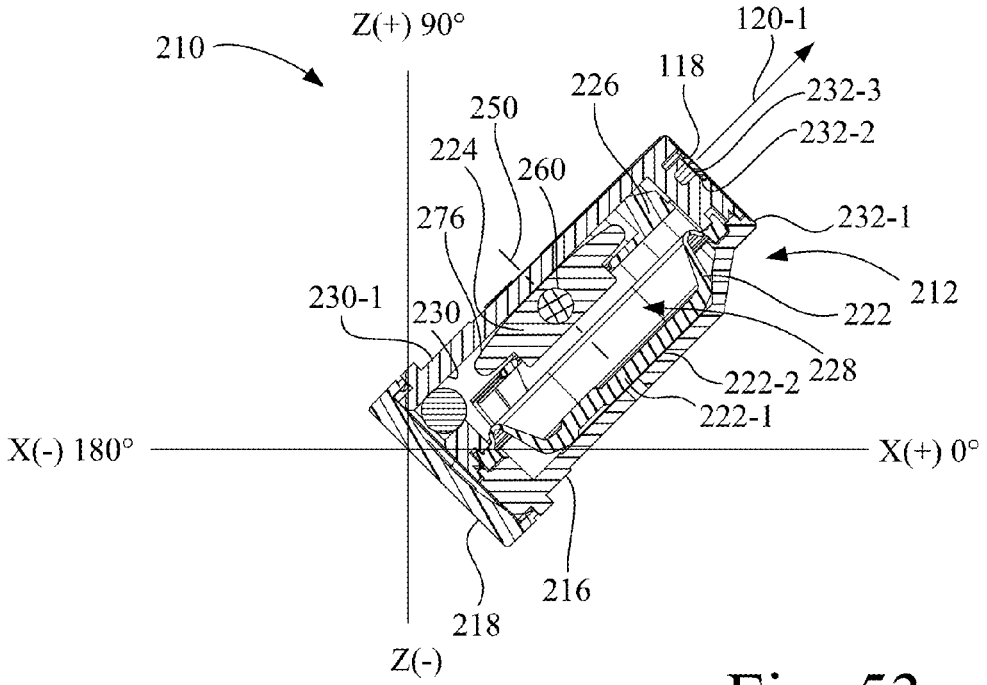
FIG. 53 shows the microfluidic dispensing device depicted in FIG. 18 at an orientation wherein the fluid ejection direction is at 45 degrees, and with the exterior of the dome portion of the diaphragm facing downwardly at 45 degrees from vertical, and with the exterior of the base wall facing upwardly at an angle of 45 degrees from vertical.

Referring to FIG. 53, alternatively, an orientation of fluid ejection direction 120-1 may be in a range of 40 degrees to 90 degrees, and wherein when the orientation is not vertical, i.e., not 90 degrees, the exterior 230-1 of base wall 230 is positioned to face upwardly and the exterior 222-2 of diaphragm 222 is positioned to face downwardly. In the specific example of FIG. 53, the orientation of microfluidic dispensing device 210 has the benefit of the nozzles-up orientation for ejection chip 118, but has the exterior 222-2 of dome portion 222-1 of diaphragm 222 switched to face downwardly at 45 degrees from vertical, and thus the exterior 230-1 of base wall 230, and correspondingly, convex surface 276 of stir bar 224 that contacts base wall 230, now faces upwardly at an angle of 45 degrees from vertical. The 45 degree orientation of microfluidic dispensing device 210 will still move the particles away from ejection chip 118 and fluid channel 26, but also will cause the particulate to settle in a region spaced away from the plurality of paddles 252, 254, 256, 258 (see also FIG. 24) of stir bar 224 and towards the dome portion 222-1 of diaphragm 222. However, if stir bar 224 can be rotated, i.e., is not blocked from rotation by particulate sediment, then the orientation depicted in FIG. 52 is preferred over the orientation depicted in FIG. 53, because in the orientation depicted in FIG. 52, the higher tip velocity of stir bar 224 will be closer to the settled particulate than in the orientation of FIG. 53.

As a general observation, the longer the time between uses of the microfluidic dispensing device or between remixing within the microfluidic dispensing device, the longer the mixing time that will be required to re-mix the fluid in the microfluidic dispensing device to achieve an acceptable level of particulate suspension, e.g., preferably, a level within the tolerances of an initial filling of the microfluidic dispensing device, as depicted in FIG. 47.

Figure 54:
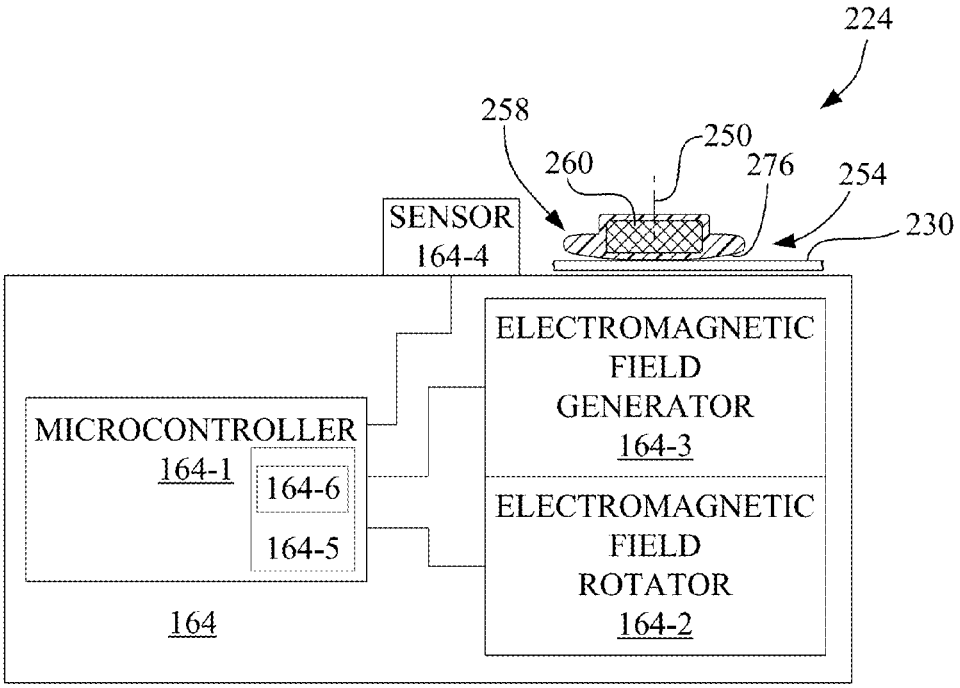
FIG. 54 is a block diagram of an external magnetic field generator used to rotate the stir bar in the various embodiments of the present invention, and having a sensor.

Referring to FIG. 54, there is shown a block diagram of external magnetic field generator 164 in accordance with an aspect of the present invention. External magnetic field generator 164 includes a microcontroller 164-1, an electromagnetic field rotator 164-2, an electromagnetic field generator 164-3, and a sensor 164-4. Microcontroller 164-1 includes a microprocessor, on-board non-transitory electronic memory 164-5, and interface circuitry, e.g., input/output circuits, a universal asynchronous receiver/transmitter (UART), analog-to-digital (A-to-D) converter, etc., as is known in the art. Microcontroller 164-1 is configured to execute program instructions to control the rotation of the magnetic field generated by external magnetic field generator 164, and in turn, to control the rotation of a stir bar, such as stir bar 224 having magnet 260.

More particularly, electromagnetic field generator 164-3 generates an external magnetic field, which is coupled to magnet 260 of stir bar 224. Microcontroller 164-1 executes program instructions to generate control signals that are supplied to electromagnetic field rotator 164-2 to control a rotational speed and rotational direction of the magnetic field generated by electromagnetic field generator 164-3, and in turn, to control the rotational speed and rotational direction of stir bar 224. During normal mixing operation, the rotational speed of stir bar 224 may be in a range, for example, of 100 to 1000 revolutions per minute. As discussed above, the external magnetic field generated by external magnetic field generator 164 may be rotated electronically, akin to operation of a stepper motor, by positioned discrete electromagnets that are selectively turned on and off to produce a virtual rotation of the magnetic field and which can switch directions, or alternatively, may be physically rotated via a magnetic plate, e.g., a permanent magnet, connected to a rotatable motor shaft.

In accordance with the present invention, sensor 164-4 has an electrical output that provides a feedback signal, which is used to determine whether or not the stir bar, e.g., stir bar 224, is rotating properly and efficiently within the fluid reservoir of the microfluidic dispensing device, e.g., microfluidic dispensing device 210. Sensor 164-4 may be, for example, a Hall-effect sensor, which generates and supplies a composite magnetic signal, in electrical form, based on the relative angular rotational position of magnet 260 of stir bar 224 and the position of the rotating magnetic field generated by electromagnetic field rotator 164-2 and electromagnetic field generator 164-3 of external magnetic field generator 164.

In the present embodiment, the control of the rotation of stir bar 224 is equivalent to driving a stepper motor. The angular rotational velocity of stir bar 224 must match the average angular rotational velocity magnetic field generated electromagnetic field rotator 164-2 and electromagnetic field generator 164-3, or else the rotational motion of stir bar 224 will "break phase" with the rotating magnetic field generated by electromagnetic field rotator 164-2 and electromagnetic field generator 164-3. As used herein, each of the terms "break phase", "breaking phase" and "broken phase" refers to a condition wherein the angular rotational velocity of the rotating magnetic field exceeds the angular rotational velocity of the stir bar, e.g., stir bar 224 having magnet 260.

In accordance with the present invention, the rotating magnetic field may be analog, as in a continuous rotation, or may be digital, as in predefined incremental angular positions.

To illustrate these concepts, please refer also to FIGS. 55-58. In each of FIGS. 55-58, both the rotational direction of a rotating magnetic field 700 generated by electromagnetic field rotator 164-2 and electromagnetic field generator 164-3 of external magnetic field generator 164, and the rotational direction of magnet 260 of stir bar 224, is in rotational direction 250-1, i.e., a counterclockwise as shown. Magnet 260 includes a north pole (N) and a south pole (S). Also, the rotating magnetic field 700 generated by electromagnetic field generator 164-3 and electromagnetic field rotator 164-2 has a north pole (N) and a south pole (S).

Figure 55:
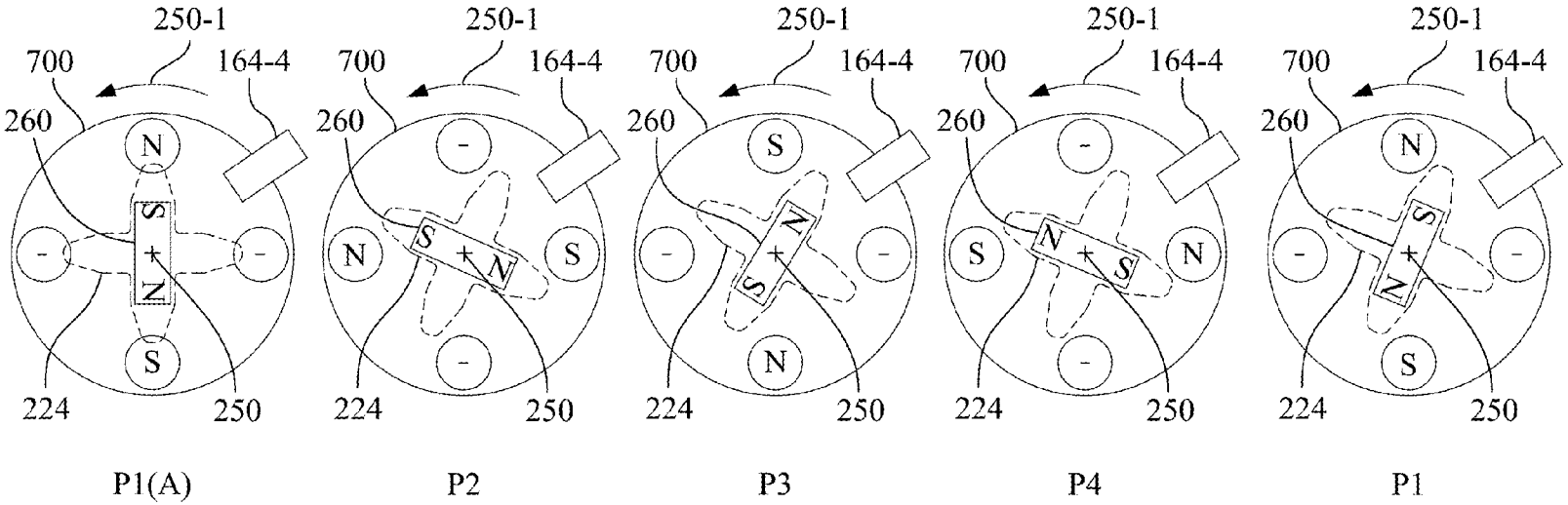
FIG. 55 is a diagrammatic illustration of an angular rotational position of a stir bar (with magnet) relative to the angular rotational position of a rotating magnetic field.

FIG. 55 illustrates stir bar 224 having magnet 260 relative to the angular rotational position of magnetic field 700 generated by electromagnetic field generator 164-3 and electromagnetic field rotator 164-2 of external magnetic field generator 164. In the present example, magnetic field 700 is depicted at four discrete angular rotational positions, individually identified as Position 1, Position 2, Position 3, and Position 4. While in the present example only four angular rotational positions are identified for ease of illustration, those skilled in the art will recognize that in practice, the number of angular rotational positions may be increased, if desired, and may correspond in number to 2×n, wherein n is a positive integer. In FIG. 55, an initial occurrence of Position 1 is identified as position P1(A), and it is to be understood that the respective N, S depictions of the angular rotational position of magnetic field 700 of position P1(A) and position P1 are identical. As the angular rotational position of magnetic field 700 generated by electromagnetic field generator 164-3 and electromagnetic field rotator 164-2 is rotated, the angular rotational position of magnet 260 of stir bar 224 attempts to follow, since unlike poles attract and like poles repel.

Referring to FIG. 55, position P1(A), if magnetic field 700 of electromagnetic field generator 164-3 is stationary and stir bar 224 is not obstructed from rotation, magnet 260 of stir bar 224 will lock onto the angular rotational position of magnetic field 700 generated by electromagnetic field generator 164-3, e.g., the north pole (N) of magnet 260 of stir bar 224 will be attracted to the south pole (S) of magnetic field 700 generated by electromagnetic field generator 164-3 of external magnetic field generator 164.

In FIG. 55, for example, positions P1(A), P2, P3, P4, and P1 depict a complete rotation of magnetic field 700 of electromagnetic field generator 164-3 and electromagnetic field rotator 164-2 from the stationary position P1(A), and a complete rotation of stir bar 224, at discrete sample times. As depicted in positions P1, P2, P3, and P4, the angular rotational position of magnet 260 of stir bar 224 may lag in phase from the angular rotational position of the rotating magnetic field 700 generated by electromagnetic field generator 164-3 and electromagnetic field rotator 164-2 of external magnetic field generator 164. Some phase lag is expected.

In the present embodiment, a range of normal phase lag (e.g., determined empirically) is defined, wherein the amount of phase lag does not adversely affect the rotational/stirring efficiency of stir bar 224. In the present example, the range of normal phase lag may be defined as a range of 0 degrees through 140 degrees. As such, a phase lag that is not normal is considered to be an abnormal phase lag, which in the present example, is a phase lag of more than 140 degrees. The abnormal phase lag will include the condition of breaking phase, and also is inclusive of the special case of breaking phase of a stuck stir bar.

In the present example of FIG. 55, the phase lag is approximately 30 degrees. As used herein, the term "approximately" means the indicated amount plus or minus 10 percent. Continuous rotation of stir bar 224 by the rotation of magnetic field 700 may be recognized by the repetition of the sequential positions P1, P2, P3, and P4.

Figure 56:
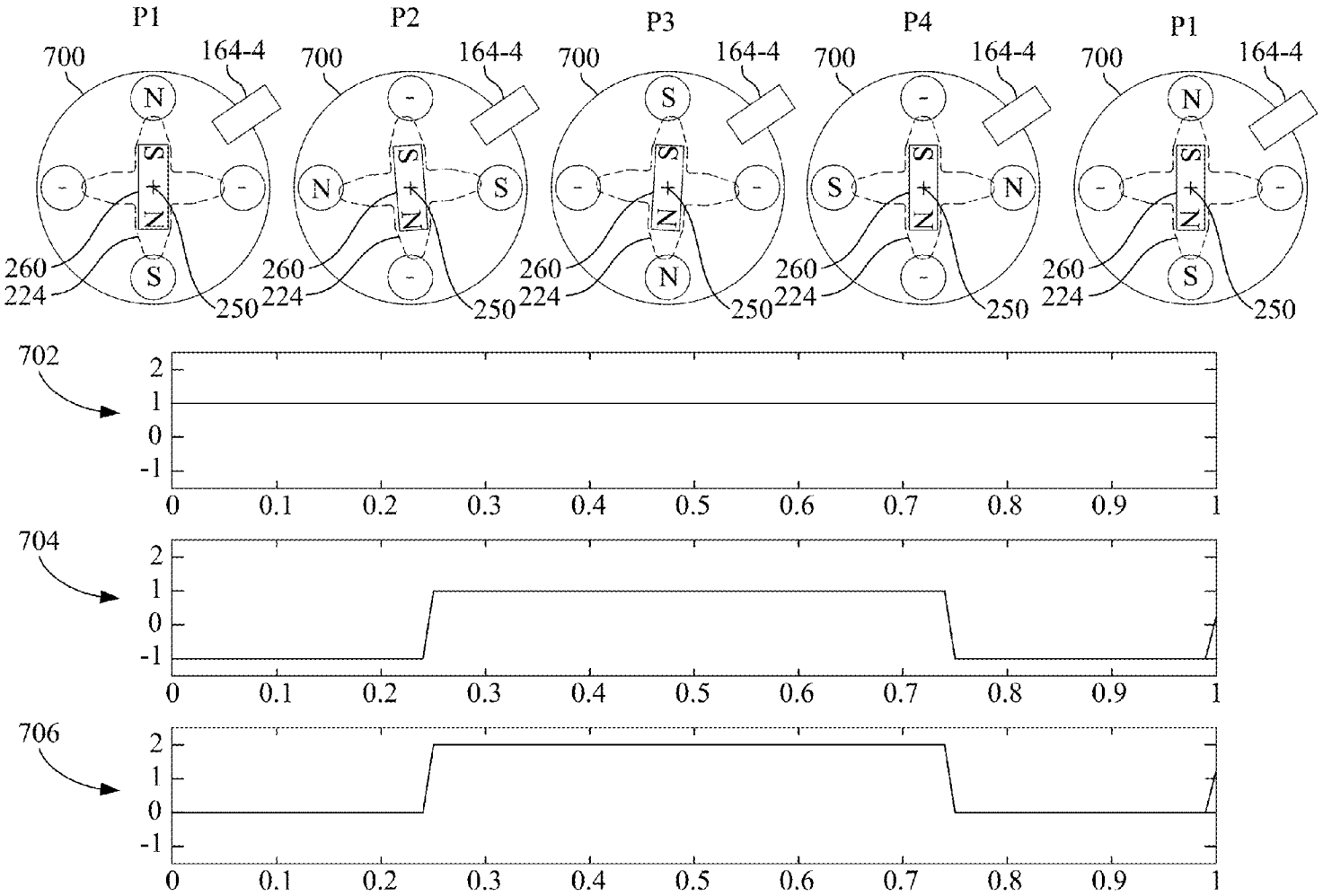
FIG. 56 is a diagrammatic illustration and graphical depiction of a scenario wherein the torque required to rotate a stir bar is too high to begin stir bar rotation, i.e., the stir bar is stuck and prevented from rotation.

FIG. 56 illustrates a scenario wherein the torque required to rotate stir bar 224 is too high to begin rotation, i.e., stir bar 224 is stuck and prevented from rotation, such as for example, by an accumulation of settled particulate around stir bar 224. As such, as illustrated at the sequence of positions P1-4, representing a completed rotation of magnetic field 700, stir bar 224 is stationary while magnetic field 700 of external magnetic field generator 164 is rotating. Thus, FIG. 56 illustrates one example wherein stir bar 224 has broken phase from the rotation of magnetic field 700 generated by electromagnetic field generator 164-3 of external magnetic field generator 164.

Another possible case where stir bar 224 would break phase from the rotating magnetic field 700 is when the acceleration rate of the angular rotational velocity of the rotation of magnetic field 700 provided by electromagnetic field rotator 164-2 and electromagnetic field generator 164-3 is faster than can be obtained by stir bar 224. In such a case, for example, the present angular rotational velocity of magnetic field 700 must be decreased such that an acceptable phase lag relationship may be obtained.

Figure 57:
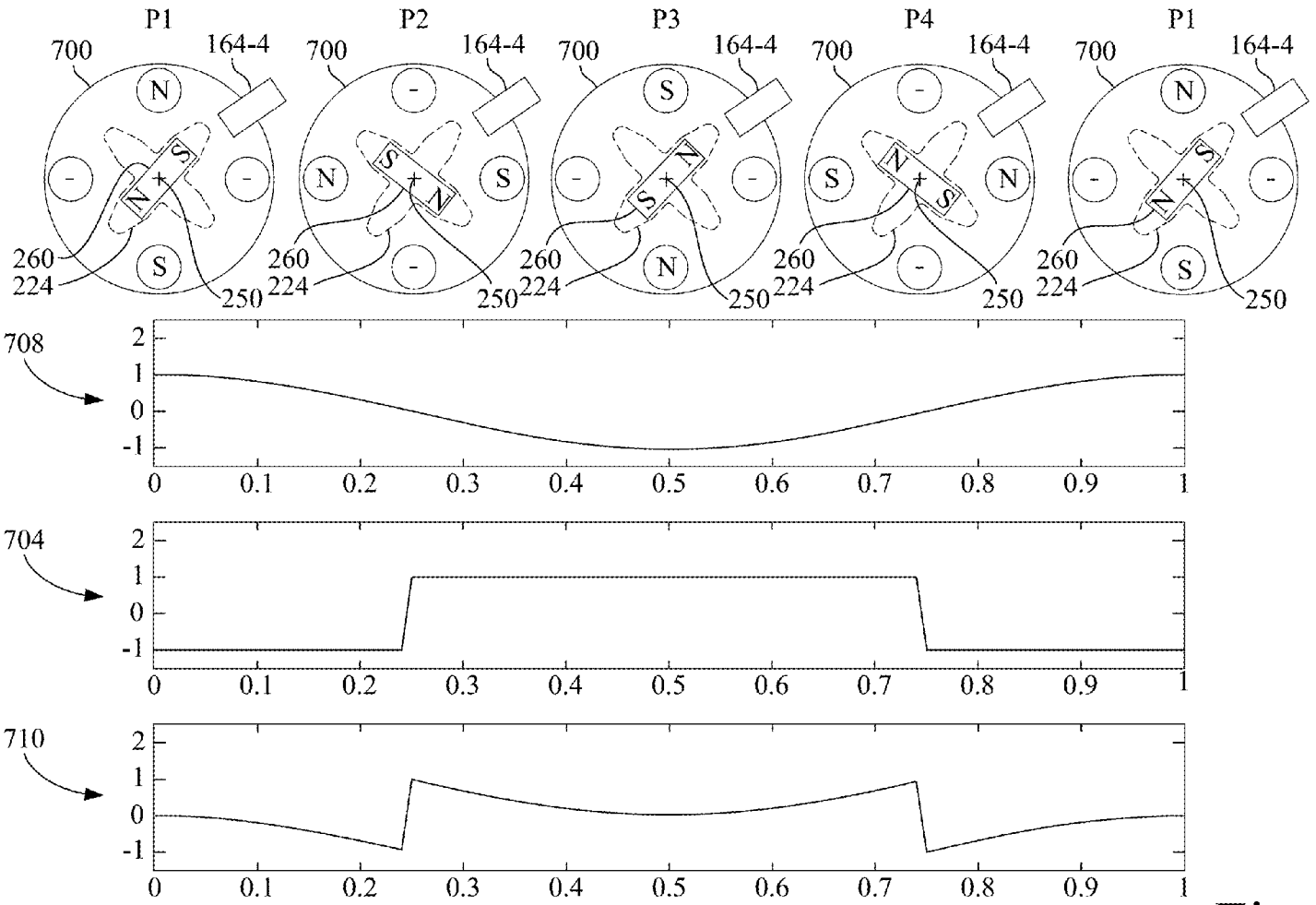
FIG. 57 is a diagrammatic illustration and graphical depiction of a scenario wherein there is a phase lag of approximately 45 degrees between the angular rotational position of a stir bar and an angular rotational position of a rotating magnetic field.

FIG. 57 illustrates a scenario wherein there is a phase lag of approximately 45 degrees between the angular rotational position of stir bar 224 and the angular rotational position of magnetic field 700 at each of the plurality of positions P1-P4 of the rotating magnetic field 700.

Figure 58:
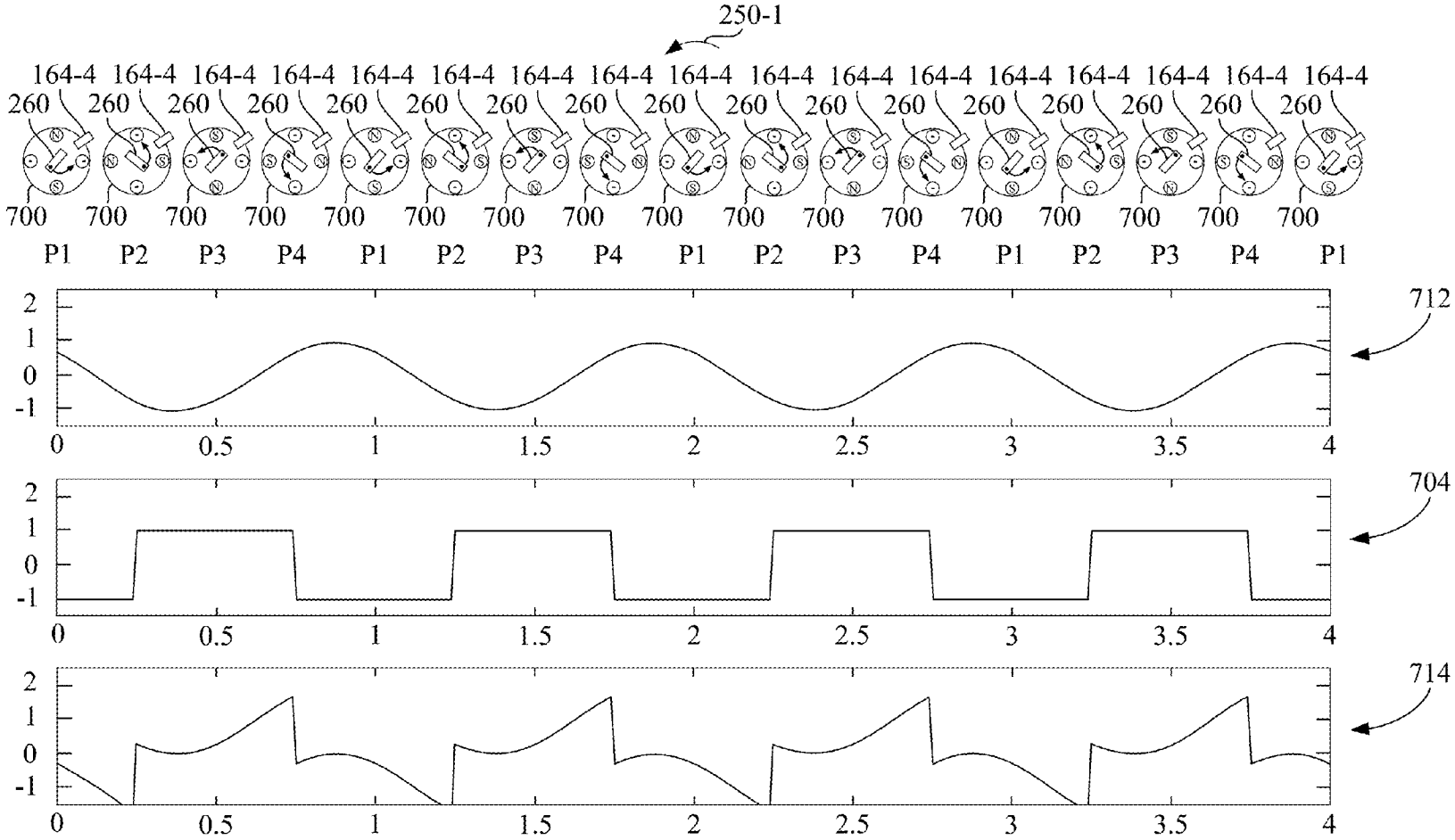
FIG. 58 is a diagrammatic illustration and graphical depiction of a scenario wherein there is a phase lag of approximately 90 degrees, represented by an arced arrowed line, between the angular rotational position of a stir bar and an angular rotational position of a rotating magnetic field.

FIG. 58 illustrates a scenario wherein there is a phase lag of approximately 90 degrees, represented by an arced arrowed line, between the angular rotational position of stir bar 224 and the angular rotational position of magnetic field 700 at each of the plurality of positions P1-P4 of the rotating magnetic field 700. Also, FIG. 58 demonstrates a plurality of rotational cycles, with each rotational cycle including a respective set of positions P1-P4. It is noted that for purposes of illustration clarity, only magnet 260 of stir bar 224 is shown in FIG. 58, and due to size restrictions in FIG. 58, the north pole (N) of magnet 260 is represented by a bold dot.

Referring again to FIGS. 56-58, each of FIGS. 56-58 include three graphs, including a stir bar magnet strength (top graph), a magnetic field strength (middle graph) of magnetic field 700, and a composite magnetic strength (lower graph), relative to the four angular rotational positions P1, P2, P3 and P4 of magnetic field 700 under the various scenarios of FIGS. 56-58. The vertical axis of each of the graphs represents a magnetic strength amplitude and the horizontal axis represents an angular rotational position, wherein the scale 0 to 1 on the horizontal axis represents one complete revolution (cycle) of magnetic field 700, corresponding to positions P1-P4 of magnetic field 700. FIG. 58 depicts multiple revolutions (cycles) of magnetic field 700, wherein each of the ranges 0-1, 1-2, 2-3, 3-4 represents one revolution of magnetic field 700. The composite magnetic strength (bottom graph) is an algebraic sum of the stir bar magnet strength (top graph) and the magnetic field strength (middle graph) at any point along the horizontal axis, and is representative of the electrical output of sensor 164-4, as a Hall Effect sensor, which receives magnetic contributions from both of the stir bar magnet 260 and magnetic field 700 during operation.

In general, it is noted that in FIGS. 56-58, the magnetic field strength profile (curve) of the magnetic field strength (middle) graph is a square wave, and will have the same profile shape, regardless of the angular rotational velocity of magnetic field 700, due to the fixed location of sensor 164-4 with respect to the rotating magnetic field 700. As such, variations in the respective shapes of the composite magnetic strength profile of the composite magnetic strength (bottom) graph as between FIGS. 56-58 are due to differences in the amount that the angular rotational position of magnet 260 of stir bar 224 lags the angular rotational position of magnetic field 700. Thus, by comparing the present output of sensor 164-4 representing a present composite magnetic strength profile with a previously stored profile database, i.e., an electronic library, of composite magnetic strength profiles, a determination may be made as to whether the stir bar is stuck, whether operating normally, i.e., within a predefined range of lag, or whether the stir has broken phase with the rotating magnetic field.

As introduced above, FIG. 56 depicts a scenario wherein stir bar 224, and in turn magnet 260, are stuck, i.e., blocked from rotation. FIG. 56 includes the three graphs described above, including a stir bar magnet strength profile 702 of magnet 260, a magnetic field strength profile 704 of magnetic field 700, and a composite magnetic strength profile 706. If desired, the stir bar magnet strength profile 702, representing a stuck stir bar, may be generated at the sensor output of sensor 164-4, for example, by taking a magnetic reading in the absence of magnetic field 700, e.g., magnetic field 700 of external magnetic field generator 164 is turned OFF. Also, if desired, the magnetic field strength profile 704 having a constant square wave shape, may be generated at the sensor output of sensor 164-4, for example, in the absence of microfluidic dispensing device 210 or in the presence of microfluidic dispensing device 210 with stir bar 224 blocked from rotation.

The composite magnetic strength profile 706 is the algebraic sum of the stir bar magnet strength profile 702 and the magnetic field strength profile 704. Since the stir bar magnet strength profile 702 (stuck stir bar) is a constant at unity, representing a non-rotation of stir bar magnet 260, then the shape of the composite magnetic strength profile 706 is the same as that of the magnetic field strength profile 704 of magnetic field 700 but for a vertical shift of unity on the vertical axis. Moreover, the composite magnetic strength profile 706 may be generated at the sensor output of sensor 164-4 by rotating magnetic field 700 while rotation of magnet 260 of stir bar 224 is blocked.

As such, referring again also to FIG. 54, the composite magnetic strength profile 706 generated by sensor 164-4 is supplied as a composite electrical signal to microcontroller 164-1, which in turn processes the composite electrical signal, e.g., through an analog-to-digital converter, and stores digital data representative of the composite magnetic strength profile 706, stuck stir bar, in a profile database 164-6 formed in electronic memory 164-5 of microcontroller 164-1 of external magnetic field generator 164. Thus, the digital representation of the composite magnetic strength profile 706 may be retrieved from the profile database 164-6 of electronic memory 164-5 for future reference as being representative of a stuck stir bar condition of stir bar 224 of microfluidic dispensing device 210. Accordingly, the composite magnetic strength profile 706 may be used by microcontroller 164-1 to aid in determining the operational status (e.g., stuck, normal, breaking phase, etc.) of stir bar 224 relative to the rotation of the rotating magnetic field 700 generated by external magnetic field generator 164.

Similarly, an electrical signal generated by sensor 164-4 representative of the magnetic field strength profile 704 may be processed by microcontroller 164-1, e.g., through an analog-to-digital converter, which in turn stores digital data representative of the magnetic field strength profile 704 in profile database 164-6 formed in electronic memory 164-5 of microcontroller 164-1 for future reference.

As introduced above, FIG. 57 illustrates a scenario wherein there is a phase lag of approximately 45 degrees between the angular rotational position of magnet 260 of stir bar 224 and the angular rotational position of magnetic field 700 at each of the plurality of positions P1-P4 of the rotating magnetic field 700. FIG. 57 includes the three types of graphs described above, including a stir bar magnet strength profile 708 of magnet 260, the magnetic field strength profile 704 of magnetic field 700, and a composite magnetic strength profile 710.

To establish the composite magnetic strength profile 710 representing a 45 degree lag, the 45 degree lag condition may be simulated in a lab setting, and then a reading of the sensor output of sensor 164-4 is taken to acquire the composite electrical signal representative of the composite magnetic strength profile 710. In particular, referring also to FIG. 54, the composite magnetic strength profile 710 generated by sensor 164-4 is supplied as a composite electrical signal to microcontroller 164-1, which in turn processes the composite electrical signal, e.g., through an analog-to-digital converter, and stores digital data representative of the composite magnetic strength profile 710, 45 degree lag, in profile database 164-6 formed in electronic memory 164-5 of microcontroller 164-1 of external magnetic field generator 164. Thus, the digital representation of the composite magnetic strength profile 710 also may be retrieved from the profile database 164-6 of electronic memory 164-5 for future reference as being representative of a 45 degree lag of magnet 260 of stir bar 224 of microfluidic dispensing device 210 relative to the rotating magnetic field 700. In turn, the composite magnetic strength profile 710 may be used by microcontroller 164-1 in determining the operational status (e.g., stuck, normal, breaking phase, etc.) of stir bar 224 relative to the rotation of the rotating magnetic field 700 generated by external magnetic field generator 164.

If desired, the stir bar magnet strength profile 708 of magnet 260 may most easily be derived by subtracting the magnetic field strength profile 704 of magnetic field 700, having the constant square wave shape, from the composite magnetic strength profile 710. This mathematical operation may be carried out by program instructions executed by microcontroller 164-1, which in turn may also store the stir bar magnet strength profile 708 of magnet 260 in profile database 164-6 formed in electronic memory 164-5 of microcontroller 164-1.

As introduced above, FIG. 58 illustrates a scenario wherein there is a phase lag of approximately 90 degrees between the angular rotational position of stir bar 224 and the angular rotational position of magnetic field 700 at each of the plurality of positions P1-P4 of the rotating magnetic field 700. FIG. 58 includes the three types of graphs described above, including a stir bar magnet strength profile 712 of magnet 260, the magnetic field strength profile 704 of magnetic field 700, and a composite magnetic strength profile 714. As a general observation, as the angular rotational velocity of stir bar 224 is increased, there will be an increase in the amount of phase lag between the angular rotational position of stir bar 224 and the angular rotational position of magnetic field 700.

To establish the composite magnetic strength profile 714 representing a 90 degree lag, the 90 degree lag condition may be simulated in a lab setting, and then a reading of the sensor output of sensor 164-4 is taken to acquire the composite electrical signal representative of the composite magnetic strength profile 714. In particular, referring also to FIG. 54, the composite magnetic strength profile 714 generated by sensor 164-4 is supplied as a composite electrical signal to microcontroller 164-1, which in turn processes the composite electrical signal, e.g., through an analog-to-digital converter, and stores digital data representative of the composite magnetic strength profile 714, having a 90 degree lag, in profile database 164-6 formed in electronic memory 164-5 of microcontroller 164-1 of external magnetic field generator 164.

Thus, the digital representation of the composite magnetic strength profile 714 also may be retrieved from the profile database 164-6 of electronic memory 164-5 for future reference as being representative of a 90 degree lag of magnet 260 of stir bar 224 of microfluidic dispensing device 210 relative to the rotating magnetic field 700. In turn, the composite magnetic strength profile 714 may be used by microcontroller 164-1 in determining the operational status (e.g., stuck, normal, breaking phase, etc.) of stir bar 224 relative to the rotation of the rotating magnetic field 700 generated by external magnetic field generator 164.

If desired, the stir bar magnet strength profile 712 of magnet 260 may most easily be derived by subtracting the magnetic field strength profile 704 of magnetic field 700, having the constant square wave shape, from the composite magnetic strength profile 714. This mathematical operation may be carried out by program instructions executed by microcontroller 164-1, which in turn may also store the stir bar magnet strength profile 712 of magnet 260 in profile database 164-6 formed in electronic memory 164-5 of microcontroller 164-1.

In accordance with the above description, composite magnetic strength profiles are stored in profile database 164-6 of electronic memory 164-5, which may be representative of a normal condition and a stuck stir bar condition. The stuck stir bar condition may be represented by a single composite magnetic strength profile, such as composite magnetic strength profile 706 of FIG. 56. The normal condition may be represented by a plurality of composite magnetic strength profiles that are in the pre-established range of normal phase lag, such as for example, a range of 0 degrees through 140 degrees.

In the example of FIGS. 57 and 58, the composite magnetic strength profile 710 representing a phase lag of 45 degrees and the composite magnetic strength profile 714 representing a phase lag of 90 degrees may be two of the plurality of composite magnetic strength profiles that are representative of a normal phase lag. For example, the normal phase lag may be represented by any number of composite magnetic strength profiles that are in the designated normal lag range. For example, the plurality of composite magnetic strength profiles representative of the normal phase lag may be established at angular increments, such as 1 degree increments, 5 degrees increments, or 10 degree increments, or other such types of increments, and stored in the profile database 164-6 of electronic memory 164-5.

Any composite magnetic strength profile read by sensor 164-4 that does not fall into the normal phase lag range by default is an abnormal phase lag, wherein a stuck stir bar is a special case of an abnormal lag condition. Thus, the normal phase lag range (representative of a normal condition) and the abnormal phase lag (representative of an abnormal condition) are mutually exclusive.

Figure 59:
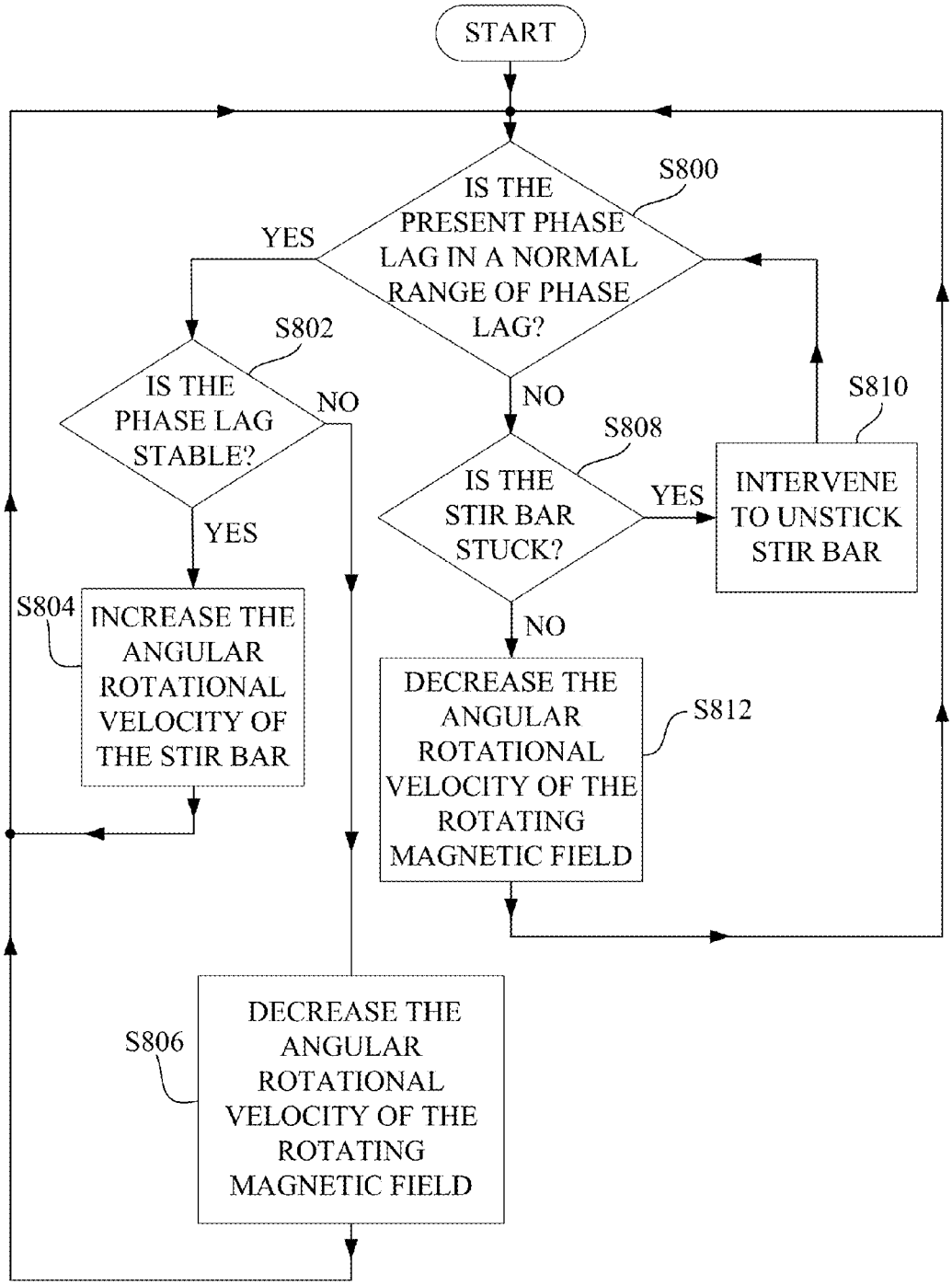
FIG. 59 is a flowchart of a method of operating a stir bar in a fluidic dispensing device, in accordance with an aspect of the present invention.

FIG. 59 is a flowchart of a method of operating a stir bar in a fluidic dispensing device, in accordance with an aspect of the present invention, with further reference to the embodiment of FIGS. 17-27, including stir bar 224. The method of FIG. 59, except for any manual intervention at step S810, may be performed by program instructions executed by microcontroller 164-1, depicted in FIG. 54.

At step S800, it is determined whether the present phase lag between the angular rotational position of the magnet 260 of stir bar 224 and the angular rotational position of magnetic field 700 generated by electromagnetic field rotator 164-2 and electromagnetic field generator 164-3 of external magnetic field generator 164 is in a range of normal phase lag.

In particular, in real time, sensor 164-4 provides electronic signals representative of a present composite magnetic strength of magnet 260 and magnetic field 700. Microcontroller 164-1 processes the electronic signals representative of a present composite magnetic strength to acquire a present composite magnetic strength. Microcontroller 164-1 then accesses profile database 164-6 of electronic memory 164-5 to compare the present composite magnetic strength to the stored plurality of composite magnetic strength profiles. If the comparison results in a match, or if the present composite magnetic strength, e.g., curve, falls between two of the stored composite magnetic strength profiles in the range of normal phase lag, then the phase lag between the angular rotational position of the magnet 260 of stir bar 224 and the angular rotational position of magnetic field 700 is in a range of normal phase lag, and stir bar 224 is considered to be operating in a normal condition, resulting in a determination of YES. Otherwise, the phase lag between the angular rotational position of the magnet 260 of stir bar 224 and the angular rotational position of magnetic field 700 is not in a range of normal phase lag, resulting in a determination of NO, and is considered an abnormal condition.

If the determination of step S800 is YES, then the process proceeds to step S802. Steps S802, S804, and S806 are directed to improving the stirring efficiency of stir bar 224 under the scenario that the phase lag is in a range of normal phase lag.

At step S802, it is determined whether the phase lag between the angular rotational position of the magnet 260 of stir bar 224 and the angular rotational position of magnetic field 700 is stable over time. As used herein, the phase lag is "stable" if a group of consecutive readings of the present composite magnetic strength from sensor 164-4 do not deviate from one another by more than a predetermined deviation, such as for example, by more than 5 percent.

If the determination at step S802 is YES, i.e., that the phase lag is stable, then at step S804, the angular rotational velocity of stir bar 224 is increased by increasing the angular rotational velocity of the rotating magnetic field 700. To help avoid a positive overshoot in angular rotational velocity, the increase will be gradual, and may be incremental, e.g., in speed increase increments of one percent. In particular, microcontroller 164-1 executes program instructions to determine whether the phase lag is stable, and if so, then sends a signal to electromagnetic field rotator 164-2 to increase the angular rotational velocity of magnetic field 700 by the specified amount. The process then returns to step S800.

If the determination at step S802 is NO, i.e., that the phase lag is not stable, then at step S806 the angular rotational velocity of the rotating magnetic field 700 is decreased. To help avoid a negative overshoot in angular rotational velocity, the decrease in the angular rotational velocity will be gradual, and may be incremental, e.g., in speed decrease increments of one percent. In particular, microcontroller 164-1 executes program instructions to determine whether the phase lag is stable, and if not, then sends a signal to electromagnetic field rotator 164-2 to decrease the angular rotational velocity of magnetic field 700 by the specified amount. The process then returns to step S800.

If the determination at step S800 is NO, i.e., the phase lag between the angular rotational position of the magnet 260 of stir bar 224 and the angular rotational position of magnetic field 700 is not in a range of normal phase lag, i.e., the phase lag is abnormal, then the process proceeds to step S808.

Steps S808, S810, and S812 are invoked under the scenario that the phase lag is not a range of normal phase lag, i.e., the phase lag is abnormal.

At step S808, it is determined whether stir bar 224 is stuck, i.e., stir bar 224 will not rotate.

In particular, in real time, sensor 164-4 provides electronic signals representative of a present composite magnetic strength of magnet 260 and magnetic field 700. Microcontroller 164-1 processes the electronic signals representative of a present composite magnetic strength to acquire a present composite magnetic strength. Microcontroller 164-1 then accesses the stuck stir bar composite magnetic strength profile, e.g., composite magnetic strength profile 706, from profile database 164-6 of electronic memory 164-5 to compare the present composite magnetic strength to the stored stuck stir bar composite magnetic strength profile.

If the comparison results in a match, then the result at step S808 is YES, indicating a stuck stir bar, i.e., the special case of an abnormal phase lag between the angular rotational position of the magnet 260 of stir bar 224 and the angular rotational position of magnetic field 700. If the comparison does not result in a match, then the result at step S808 is NO, and the phase lag is considered to be a general case of abnormal phase lag, and the process proceeds to step S812.

If the determination at step S808 is YES, that stir bar 224 is stuck, then the process proceeds to S810, wherein a user intervention may be invoked to unstick the stuck stir bar. It has been observed that changing the orientation of microfluidic dispensing device to use gravity to move the particulate and break up the layer formed by settled particulate, such as settled particulate 604 of FIGS. 48-50, may be used to free a stir bar, such as stir bar 224, which is stuck from rotation by the accumulated settled particulate 604. In this regard, please see the discussion above with respect to FIGS. 47-53. It is noted that shallow ejection chip angles will not be able to use gravity as effectively in moving sediment that may have settled in the ejection chip region including the fluid channel, such as for example, during a shipping condition.

A further option in attempting to break up the layer formed by settled particulate, such as settled particulate 604 depicted in FIG. 50, may be obtained by vibrating microfluidic dispensing device 210. Such haptic vibration may also help to clear the fluid channel, e.g., fluid channel 246 of FIGS. 48-50, and may be induced automatically upon occurrence of the YES determination at step S808. The frequency and intensity of the haptic vibration may be determined empirically, and may be dependent, at least in part, on the amount of particulate in the fluid.

Following intervention at step S810, the process is returns to step S800.

If the determination at step S808 is NO, that stir bar 224 is not stuck, then the assumption is made that the abnormal phase lag is due to some other cause, such as due to the magnet 260 of stir bar 224 breaking phase with the rotating magnetic field 700 provided by electromagnetic field rotator 164-2 and electromagnetic field generator 164-3, and the process proceeds to step S812.

At step S812, the angular rotational velocity of rotating magnetic field 700 is decreased. To help avoid a negative overshoot in the correction of the angular rotational velocity of rotating magnetic field 700, the decrease in angular rotational velocity will be gradual, and may be incremental, e.g., in speed decrease increments of one percent. In particular, microcontroller 164-1 executes program instructions to decrease the angular rotational velocity of magnetic field 700 by the specified amount. For example, the angular rotational velocity of the rotating magnetic field 700 is decreased until the normal phase lag associated with steps S800 through S804 is again achieved. Following step S812, the process returns to step S800.

It is contemplated that the determination made at step S800 may be simplified to a predefined number of conditions, such as for example, a normally operating stir bar, a stuck stir bar, and a stir bar that has broken phase with the rotating magnetic field, wherein steps S800 and S808 may be essentially combined into a single step having three possible outcomes.

Also, from the information obtained above, an estimate of viscosity of the mixed or unmixed fluid is possible by correlating the phase lag or peak angular rotational velocity of stir bar 224 with various levels of viscosity, e.g., by empirically establishing a viscosity curve, and comparing the present phase lag or peak angular rotational velocity of stir bar 224 with the viscosity curve. For a digitally changing magnetic field 700, a step response signal, e.g., step-wise increasing the angular rotational velocity of magnetic field 700, may also be used to determine an estimate of fluid viscosity in microfluidic dispensing device 210.

Further, it is contemplated that additional sensors, like sensor 164-4, e.g., additional Hall Effect sensors, may be used to further improve signal detection and profile generation. Also, it is noted that for the more analog rotating magnetic fields, a digital Hall Effect sensor can be used to look at the time periods instead of amplitudes in generating the composite magnetic strength profiles.

As an alternative to the above method using a Hall Effect sensor as sensor 164-4, it is contemplated that sensor 164-4 may be a vibration sensor. A vibration sensor will generate different signal signatures from the composite magnetic strength profile generated by a Hall Effect sensor, and rather, the vibration sensor directly generates an electronic vibration profile that may be substituted for the composite magnetic strength profile in the method described above. In such a case, the vibration sensor (acceleration, velocity, or positional) measures the differences caused by changes in magnetic attraction and repulsion between magnet 260 of stir bar 224 and the rotating magnetic field 700.

For example, if magnet 260 of stir bar 224 is rotating normally, the phase lag between magnet 260 of stir bar 224 and magnetic field 700 results in sensor 164-4, as a vibration sensor, generating a fairly uniform vibration signal because the magnet attraction, and thus the phase lag, during rotation is stable (see also step S802 described above).

In an abnormal phase lag condition of a loss of phase, there is a periodic repulsion of magnet 260 of stir bar 224 and magnetic field 700 that results in sensor 164-4, as a vibration sensor, generating a corresponding vibration pulse parallel to the axis of rotation, e.g., is strongest each time a pole of magnet 260 of stir bar 224 coincides with a like pole of magnetic field 700. In this condition, the stir bar is rotating erratically and inefficiently.

In a stir bar stuck condition, there the periodic repulsion of magnet 260 of stir bar 224 and magnetic field 700 occurs once per revolution, sensor 164-4 (as a vibration sensor) will generate the strongest signal parallel to the axis of rotation.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluidic dispensing device, comprising:

a fluid reservoir containing fluid;

a stir bar located in the fluid reservoir and having a magnet;

a generator that generates a rotating magnetic field to interact with the magnet; and a controller that:

determines a range of a predetermined phase lag between an angular rotational position of the stir bar and an angular rotational position of the rotating magnetic field, determines a status of a present phase lag based on the range of the predetermined phase lag, and takes predetermined action based on the status, wherein the status includes a normal phase lag and an abnormal phase lag, and wherein if the abnormal phase lag indicates a stuck stir bar, then at least one of an orientation of the fluidic dispensing device is changed and a haptic vibration is introduced.

2. The fluidic dispensing device of claim 1, wherein if the present phase lag between the angular rotational position of the magnet of the stir bar and the angular rotational position of the rotating magnetic field is in the range of normal phase lag, then adjusting the angular rotational velocity of the rotating magnetic field.

3. The fluidic dispensing device of claim 1, wherein the controller includes a microcontroller communicatively coupled to a Hall-effect sensor.

4. The fluidic dispensing device of claim 1, wherein the controller includes a microcontroller communicatively coupled to a vibration sensor.

5. A fluidic dispensing device, comprising:

a fluid reservoir containing fluid;

a stir bar located in the fluid reservoir and having a magnet;

a generator that generates a rotating magnetic field to interact with the magnet; and a controller that:

determines a range of a predetermined phase lag between an angular rotational position of the stir bar and an angular rotational position of the rotating magnetic field, determines a status of a present phase lag based on the range of the predetermined phase lag, and takes predetermined action based on the status, wherein the status includes a normal phase lag and an abnormal phase lag, and wherein if the abnormal phase lag is indicative of the stir bar not being stuck, then decreasing the angular rotational velocity of the rotating magnetic field until the normal phase lag is again achieved.

6. A method of operating a stir bar in a fluidic dispensing device, the fluidic dispensing device having a fluid reservoir containing fluid, the stir bar being located in the fluid reservoir, the stir bar having a magnet, the method comprising:

generating a rotating magnetic field;

establishing a range of normal phase lag between an angular rotational position of the stir bar and an angular rotational position of the rotating magnetic field; and determining whether a present phase lag between the angular rotational position of the magnet of the stir bar and the angular rotational position of the rotating magnetic field is in the range of normal phase lag, wherein:

if the present phase lag between the angular rotational position of the magnet of the stir bar and the angular rotational position of the rotating magnetic field is in the range of normal phase lag, then adjusting at least one of the angular rotational velocity of the stir bar and the angular rotational velocity of the rotating magnetic field, wherein if the present phase lag is not in the range of the normal phase lag, then designating the present phase lag as an abnormal phase lag and taking a corrective action, and wherein the corrective action includes determining whether the abnormal phase lag is indicative of the stir bar being stuck, and if the stir bar is stuck, then intervening to unstick the stuck stir bar.

7. The method of claim 6, wherein the act of adjusting further includes determining whether a phase lag between the angular rotational position of the magnet of the stir bar and the angular rotational position of the rotating magnetic field is stable over time, wherein if the phase lag is stable, then increasing the angular rotational velocity of the stir bar.

8. The method of claim 6, wherein the act of adjusting further includes determining whether a phase lag between the angular rotational position of the magnet of the stir bar and the angular rotational position of the rotating magnetic field is stable over time, wherein if the phase lag is not stable, then decreasing the angular rotational velocity of the rotating magnetic field.

9. The method of claim 6, wherein the act of intervening is at least one of changing an orientation of the fluidic dispensing device and introducing haptic vibration.

10. The method of claim 6, wherein the corrective action includes decreasing the angular rotational velocity of the rotating magnetic field to correct the abnormal phase lag.

* * * * *